US011348569B2

(12) United States Patent
Tamura et al.

(10) Patent No.: US 11,348,569 B2
(45) Date of Patent: May 31, 2022

(54) SPEECH PROCESSING DEVICE, SPEECH PROCESSING METHOD, AND COMPUTER PROGRAM PRODUCT USING COMPENSATION PARAMETERS

(71) Applicant: KABUSHIKI KAISHA TOSHIBA, Tokyo (JP)

(72) Inventors: Masatsune Tamura, Kanagawa (JP); Masahiro Morita, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 106 days.

(21) Appl. No.: 16/841,839

(22) Filed: Apr. 7, 2020

(65) Prior Publication Data

US 2020/0234692 A1 Jul. 23, 2020

Related U.S. Application Data

(60) Division of application No. 15/898,337, filed on Feb. 16, 2018, now Pat. No. 10,650,800, which is a (Continued)

(51) Int. Cl.

| | |
|---|---|
| ***G10L 25/18*** | (2013.01) |
| ***G10L 13/06*** | (2013.01) |
| ***G10L 13/047*** | (2013.01) |

(52) U.S. Cl.

CPC ..... *G10L 13/06* (2013.01); *G10L 13/047* (2013.01); *G10L 25/18* (2013.01)

(58) Field of Classification Search

CPC ..... G10L 13/06; G10L 13/047; G10L 25/18 (Continued)

(56) References Cited

U.S. PATENT DOCUMENTS 5,701,390 A 12/1997 Griffin et al.
8,321,208 B2 11/2012 Tamura et al.
(Continued)

FOREIGN PATENT DOCUMENTS

EP 2 881 947 A1 6/2015
JP H08-272398 A 10/1996
(Continued)

OTHER PUBLICATIONS

Notice of Allowance on U.S. Appl. No. 16/841,833 dated Jul. 14, 2021.
(Continued)

*Primary Examiner* — Susan I McFadden
(74) *Attorney, Agent, or Firm* — Foley & Lardner LLP

(57) ABSTRACT

A speech processing device includes a hardware processor configured to receive input speech and extract speech frames from the input speech. The hardware processor is configured to calculate a spectrum parameter for each of the speech frames, calculate a first phase spectrum for each of the speech frames, calculate a group delay spectrum from the first phase spectrum based on a frequency component of the first phase spectrum, calculate a band group delay parameter in a predetermined frequency band from the group delay spectrum, and calculate a band group delay compensation parameter to compensate a difference between a second phase spectrum reconstructed from the band group delay parameter and the first phase spectrum. The hardware processor is configured to generate a speech waveform based on the spectrum parameter, the band group delay parameter, and the band group delay compensation parameter.

4 Claims, 27 Drawing Sheets

Related U.S. Application Data continuation of application No. PCT/JP2015/076361, filed on Sep. 16, 2015.

(58) Field of Classification Search
USPC ..... 704/261
See application file for complete search history.

(56) References Cited

U.S. PATENT DOCUMENTS

| | | | |
|---|---|---|---|
| 8,438,033 | B2 | 5/2013 | Tamura et al. |
| 8,719,030 | B2 | 5/2014 | Chen |
| 10,650,800 | B2 * | 5/2020 | Tamura ..... G10L 25/18 |
| 2012/0053933 | A1 | 3/2012 | Tamura et al. |
| 2012/0265534 | A1 | 10/2012 | Coorman et al. |
| 2013/0179158 | A1 | 7/2013 | Nakamura et al. |
| 2013/0262087 | A1 | 10/2013 | Ohtani et al. |

FOREIGN PATENT DOCUMENTS

| | | | |
|---|---|---|---|
| JP | 2001-249674 | A | 9/2001 |
| JP | 2002-268660 | A | 9/2002 |
| JP | 5085700 | B2 | 11/2012 |
| JP | 2013-015829 | A | 1/2013 |
| JP | 2013-164572 | A | 8/2013 |
| JP | 2013-205697 | A | 10/2013 |
| WO | WO-2014/021318 | A1 | 2/2014 |

OTHER PUBLICATIONS

Banno et al., "Efficient Representation of Short-Time Phase Based on Time-Domain Smoothed Group Delay", D-II vol. J84-D-11, No. 4, 2001, pp. 621-628 (2001), with English Translation.

Zen et al., "Details of the Nitech HMM-Based Speech Synthesis System for the Blizzard Challenge 2005", IEICE Trans. Inf. Syst., vol. E90-D, No. 1, Jan. 2007, pp. 325-333.

* cited by examiner

SPEECH FRAME

AMPLITUDE SPECTRUM

MEL-LSP COEFFICIENT AND SPECTRAL ENVELOPE

PHASE SPECTRUM

GROUP DELAY SPECTRUM

BAND GROUP DELAY PARAMETER

PHASE GENERATED BASED ON BAND GROUP DELAY PARAMETER

SYNTHESIZED WAVEFORM BASED ON BAND GROUP DELAY PARAMETER

BAND GROUP DELAY PARAMETER AND COMPENSATION PARAMETER

PHASE GENERATED BASED ON BAND GROUP DELAY PARAMETER AND COMPENSATION PARAMETER

SYNTHESIZED WAVEFORM BASED ON BAND GROUP DELAY PARAMETER AND COMPENSATION PARAMETER

SPEECH WAVEFORM (ORIGINAL SOUND)

SYNTHESIZED SPEECH WAVEFORM BASED ON BAND GROUP DELAY PARAMETER AND BAND GROUP DELAY COMPENSATION PARAMETER

SYNTHESIZED SPEECH WAVEFORM BASED ON BAND GROUP DELAY PARAMETER

FIXED PHASE/
WHOLE BAND

LINEAR PHASE/
WHOLE BAND

LINEAR PHASE/BAND
$\Omega_b$

SPEECH WAVEFORM (ORIGINAL SOUND)

SYNTHESIZED SPEECH WAVEFORM BASED ON VOCODER SPEECH SYNTHESIS PROCESSING

SYNTHESIZED SPEECH WAVEFORM (MINIMUM PHASE) BASED ON PULSE EXCITATION VOCODER

SPEECH PROCESSING DEVICE, SPEECH PROCESSING METHOD, AND COMPUTER PROGRAM PRODUCT USING COMPENSATION PARAMETERS

CROSS-REFERENCE TO RELATED APPLICATIONS

This application is a divisional of U.S. patent application Ser. No. 15/898,337 filed on Feb. 16, 2018, which is a continuation of PCT international application Ser. No. PCT/JP2015/076361 filed on Sep. 16, 2015; the entire contents of all of the above applications are incorporated herein by reference.

FIELD

Embodiments of the present invention relate to a speech processing device, a speech processing method, and a computer program product.

BACKGROUND

Speech analyzers that analyze speech waveforms to extract feature parameters and speech synthesizers that synthesize speech based on the feature parameters obtained by speech analyzers have been widely used in speech processing techniques such as a text-to-speech synthesis technique, a speech coding technique and a speech recognition technique.

However, conventionally, there is a problem that there is a difficulty in use for a statistical model, or that a deviation occurs between a reconstructed phase and a phase of an analysis source waveform. In addition, conventionally, there is a problem that it is difficult to generate a waveform rapidly when generating the waveform using a group delay feature amount. An object of the present invention is to provide a speech processing device, a speech processing method, and a computer program product which make it possible to enhance reproducibility of a speech waveform.

DETAILED DESCRIPTION

A speech processing device of an embodiment includes a spectrum parameter calculation unit, a phase spectrum calculation unit, a group delay spectrum calculation unit, a band group delay parameter calculation unit, and a band group delay compensation parameter calculation unit. The spectrum parameter calculation unit calculates a spectrum parameter. The phase spectrum calculation unit calculates a first phase spectrum. The group delay spectrum calculation unit calculates a group delay spectrum from the first phase spectrum based on a frequency component of the first phase spectrum. The band group delay parameter calculation unit calculates a band group delay parameter in a predetermined frequency band from a group delay spectrum. The band group delay compensation parameter calculation unit calculates a band group delay compensation parameter to compensate a difference between a second phase spectrum reconstructed from the band group delay parameter and the first phase spectrum.

(First Speech Processing Device: Speech Analyzer)

Figure 1:
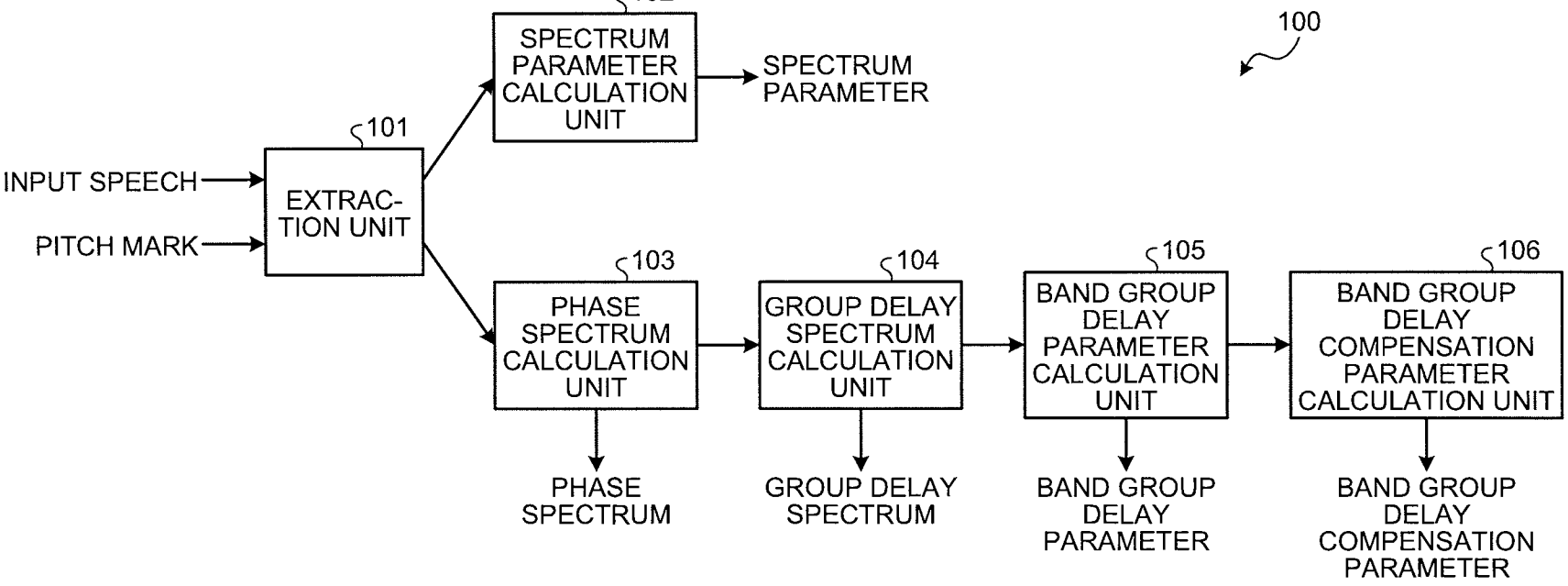
FIG. 1 is a block diagram illustrating a configuration example of a speech analyzer according to an embodiment.

Next, a first speech processing device according to an embodiment, that is, a speech analyzer will be described with reference to the attached drawings. FIG. 1 is a block diagram illustrating a configuration example of a speech analyzer 100 according to the embodiment. As illustrated in FIG. 1, the speech analyzer 100 includes an extraction unit (speech frame extraction unit) 101, a spectrum parameter calculation unit 102, a phase spectrum calculation unit 103, a group delay spectrum calculation unit 104, a band group delay parameter calculation unit 105, and a band group delay compensation parameter calculation unit 106.

The extraction unit 101 receives input speech and a pitch mark, extract the input speech in units of frames, and outputs the speech frame (speech frame extraction). A processing example performed by the extraction unit 101 will be described later with reference to FIG. 2. The spectrum parameter calculation unit (a first calculation unit) 102 calculates a spectrum parameter from a speech frame output by the extraction unit 101. A processing example performed by the spectrum parameter calculation unit 102 will be described later with reference to FIGS. 3A, 3B and 3C.

The phase spectrum calculation unit (a second calculation unit) 103 calculates a phase spectrum of the speech frame output by the extraction unit 101. A processing example performed by the phase spectrum calculation unit 103 will be described later with reference to FIG. 4A. The group delay spectrum calculation unit (a third calculation unit) 104 calculates a group delay spectrum to be described later from the phase spectrum calculated by the phase spectrum calculation unit 103. A processing example performed by the group delay spectrum calculation unit 104 will be described later with reference to FIG. 4B.

The band group delay parameter calculation unit (a fourth calculation unit) 105 calculates a band group delay parameter from the group delay spectrum calculated by the group delay spectrum calculation unit 104. A processing example performed by the band group delay parameter calculation unit 105 will be described later with reference to FIGS. 6A, 6B and 6C. The band group delay compensation parameter calculation unit (a fifth calculation unit) 106 calculates a compensation amount (a band group delay compensation parameter or a compensation parameter) to compensate a difference between a phase spectrum reconstructed from the band group delay parameter calculated by the band group delay parameter calculation unit 105, and the phase spectrum calculated by the phase spectrum calculation unit 103. A processing example performed by the band group delay compensation parameter calculation unit 106 will be described later with reference to FIGS. 7A, 7B and 7C.

Next, the processing performed by the speech analyzer 100 will be described in more detail. Here, a description will be given regarding a case of performing feature parameter analysis by pitch synchronous analysis with respect to the processing performed by the speech analyzer 100.

Figure 2:
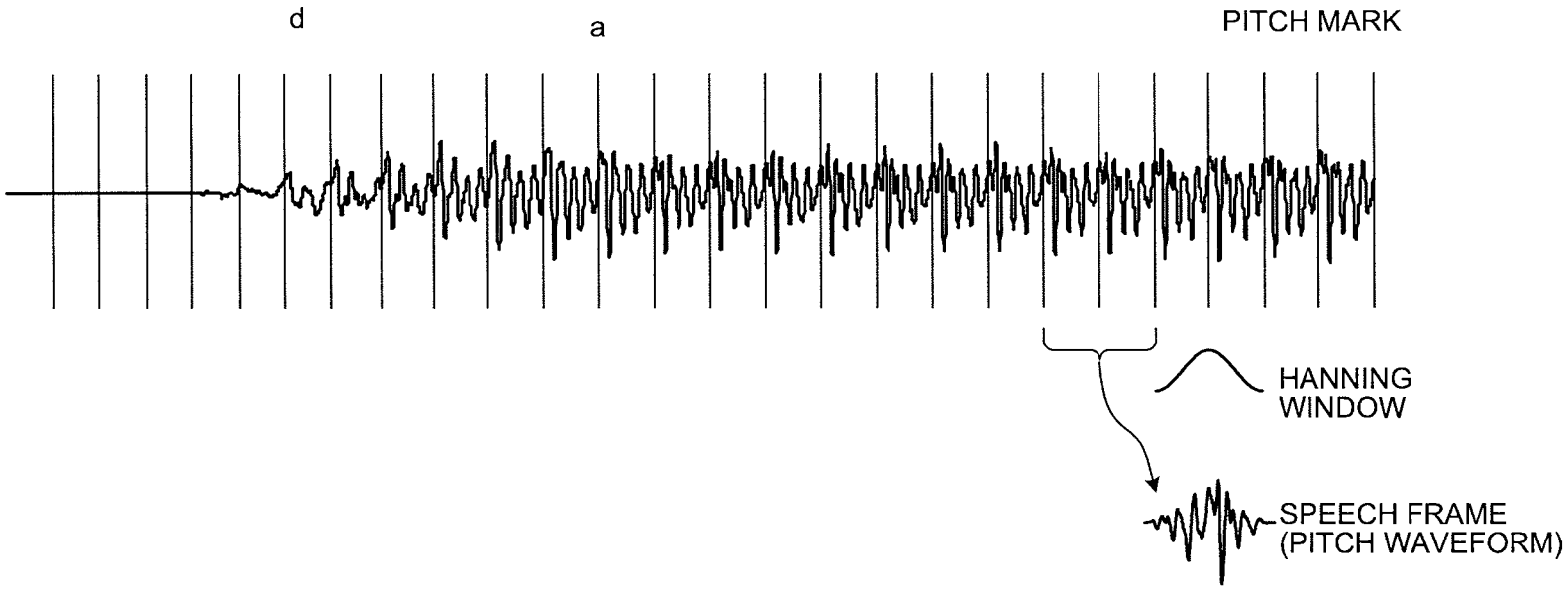
FIG. 2 is a graph illustrating a speech waveform and a pitch mark received by an extraction unit.

The extraction unit 101 receives pitch mark information representing a center time of each speech frame based on a periodicity thereof together with the input speech. FIG. 2 is a graph illustrating the speech waveform and the pitch mark received by the extraction unit 101. FIG. 2 illustrates a waveform of speech of "Da" and illustrates a pitch mark time extracted in accordance with periodicity of voiced sound together with the speech waveform.

Hereinafter, an analysis example for a section (underlined section) illustrated on the lower side of FIG. 2 will be described as a sample of a speech frame. The extraction unit 101 extract the speech frame by multiplying a window function having a length twice of a length of a pitch with a pitch mark at the center. The pitch mark is obtained by, for example, a method of extracting a pitch by a pitch extraction device and extracting a peak of a pitch period. In addition, it is also possible to use even an unvoiced sound section having no periodicity as the pitch mark by creating a time sequence as an analysis center using a process of interpolating a fixed frame rate and a pitch mark of a periodic section.

A Hanning window can be used to extract the speech frame. In addition, window functions having different characteristics, such as a Hamming window and a Blackman window may also be used. The extraction unit 101 uses the window function to extract a pitch-cycle waveform, which is a unit waveform of the periodic section, as the speech frame. In addition, the extraction unit 101 also cuts out a speech frame by multiplying the window function in accordance with a time determined by interpolating the fixed frame rate and the pitch mark in an aperiodic section such as a silent or unvoiced sound section as described above.

Although the description is given by exemplifying the case where the pitch synchronization analysis is used to extract the spectrum parameter, the band group delay parameter, and the band group delay compensation parameter in the present embodiment, the invention is not limited thereto, and the parameter extraction may be performed using the fixed frame rate.

The spectrum parameter calculation unit 102 obtains the spectrum parameter for the speech frame extracted by the extraction unit 101. For example, the spectrum parameter calculation unit 102 obtains an arbitrary spectrum parameter representing a spectral envelope such as mel-cepstrum, a linear predictive coefficient, mel-LSP, and a sine wave model. In addition, even when the analysis using the fixed frame rate is performed instead of the pitch synchronous analysis, the parameter extraction may be performed by using these parameters or a spectral envelope extraction method based on STRAIGHT analysis. Here, for example, a spectrum parameter based on the mel-LSP is used.

Figure 3A:
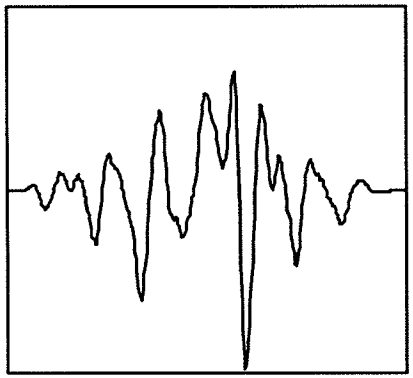
FIGS. 3A, 3B and 3C are graphs illustrating a processing example of a spectrum parameter calculation unit.
Figure 3B:
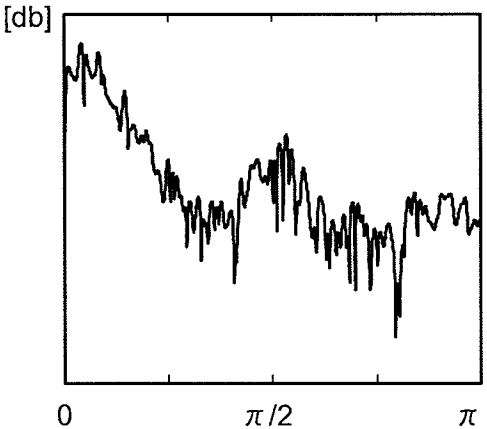
Figure 3C:
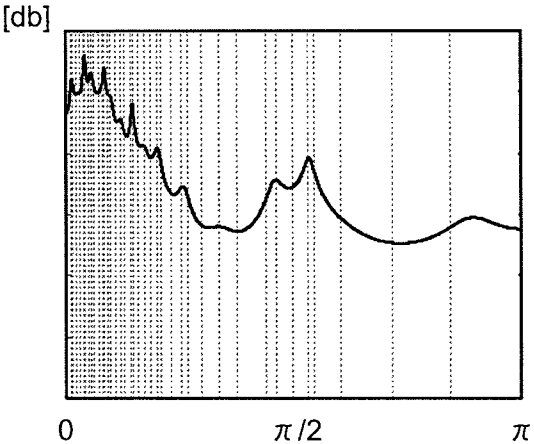

FIGS. 3A, 3B and 3C are graphs illustrating the processing example of the spectrum parameter calculation unit 102. FIG. 3A illustrates a speech frame, and FIG. 3B illustrates a spectrum obtained by Fourier transformation. The spectrum parameter calculation unit 102 applies mel-LSP analysis to this spectrum, thereby obtaining a mel-LSP coefficient. The zeroth order of the mel-LSP coefficient represents a gain term, and the first or higher order represents a line spectrum frequency on a frequency axis, and a grid line is illustrated for each LSP frequency. Here, the mel-LSP analysis is applied to speech of 44.1 kHz. A spectral envelope obtained in this manner is a parameter representing an outline of a spectrum (FIG. 3C).

Figure 4A:
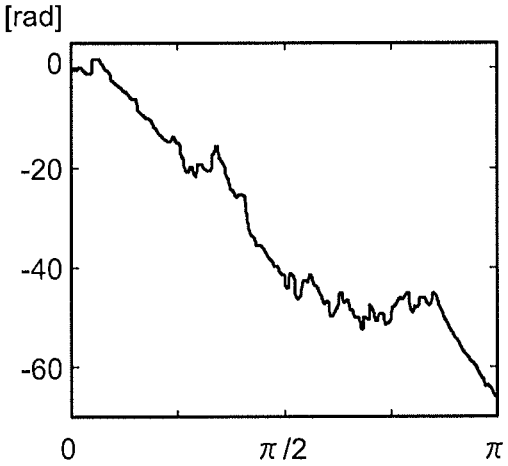
FIGS. 4A and 4B are graphs illustrating a processing example of a phase spectrum calculation unit and processing of a group delay spectrum calculation unit.
Figure 4B:
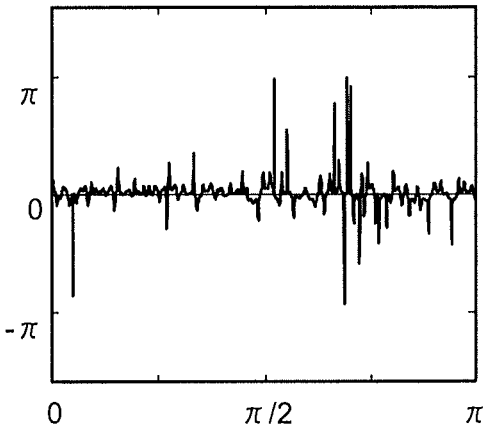

FIGS. 4A and 4B are graphs illustrating the processing example of the phase spectrum calculation unit 103 and the processing example of the group delay spectrum calculation unit 104. FIG. 4A illustrates a phase spectrum obtained by the phase spectrum calculation unit 103 using Fourier transformation. The phase spectrum is obtained by unwrapping. The phase spectrum calculation unit 103 applies a high-pass filter to both an amplitude and a phase so as to make a phase of a direct current component zero, thereby obtaining the phase spectrum.

The group delay spectrum calculation unit 104 obtains the group delay spectrum illustrated in FIG. 4B by the following Formula 1 from the phase spectrum illustrated in FIG. 4A.

$$\tau(\omega)=-\varphi'(\omega) \quad (1)$$

In the above Formula 1, $\tau(\omega)$ represents the group delay spectrum, $\psi(\omega)$ represents the phase spectrum, and "'" represents a differential operation. A group delay is a phase frequency differential and is a value representing an average time (a time of center of gravity or a delay time) of each band in a time domain. Since the group delay spectrum corresponds to a differential value of an unwrapped phase, a range thereof has a value between $-\pi$ and $\pi$.

Here, it is understood that a group delay close to $-\pi$ occurs in a low-frequency band when referring to FIG. 4B. That is, a difference close to $\pi$ occurs in the phase spectrum at the relevant frequency. In addition, a valley is viewed at a position of the relevant frequency when referring to an amplitude spectrum in FIG. 3B.

Such a shape is given since a sign of a signal is reversed in the low-frequency band and a high-frequency band divided at this frequency, and a frequency at which a level difference occurs in the phase represents a frequency as a boundary between the low-frequency and high-frequency bands. It is important to reproduce a discontinuous change in group delay including such a group delay near it on the frequency axis in order to reproduce a speech waveform as an analysis source and obtain high quality analyzed and synthesized speech. In addition, it is desired for the group delay parameter used for speech synthesis to be a parameter capable of reproducing such an abrupt change in group delay.

The band group delay parameter calculation unit 105 calculates the band group delay parameter from the group delay parameter calculated by the group delay spectrum calculation unit 104. The band group delay parameter is a group delay parameter for each predetermined frequency band. As a result, the group delay parameter becomes a parameter that reduces the order of the group delay spectrum and is usable as a parameter of a statistical model. The band group delay parameter is obtained by the following Formula 2.

$$bgrd(b)=\int_{\Omega_b}^{\Omega_{b+1}}\tau(\omega)|S(\omega)|^2 d\omega \tag{2}$$

A band group delay according to the above Formula 2 represents an average time in the time domain and represents a shift amount from a zero phase waveform. In the case of obtaining the average time from the discrete spectrum, the following Formula 3 is used.

$$bgrd(b) = \frac{\sum_{\omega=\Omega_b}^{\Omega_{b+1}} \tau(\omega)|S(\omega)|^2}{\sum_{\omega=\Omega_b}^{\Omega_{b+1}} |S(\omega)|^2} \tag{3}$$

Here, weighting based on a power spectrum is used as the band group delay parameter, but an average of group delays may be simply used. In addition, a different calculation method such as weighted averaging based on an amplitude spectrum may be used, and it is sufficient if a parameter represents the group delay of each band.

In this manner, the band group delay parameter is the parameter representing the group delay of the predetermined frequency band. Accordingly, reconstruction of a group delay from the band group delay parameter is performed by using the band group delay parameter corresponding to each frequency as expressed in the following Formula 4.

$$\hat{\tau}(\omega)=bgrd(b) \ldots (\Omega_b \leq \omega < \Omega_{b+1}) \tag{4}$$

Reconstruction of a phase from this generated group delay is obtained by the following Formula 5.

$$\hat{\varphi}(\omega)=\hat{\Omega}(\omega-1)-\hat{\tau}(\omega) \ldots \omega>0,$$

$$\hat{\varphi}(0)=0 \tag{5}$$

Although an initial value of a phase at $\omega=0$ is zero since the above-described high-pass processing is applied thereto, the phase of the direct current component may be actually stored and used. Here, $\Omega_b$ used in the formulas is a frequency scale which is the boundary between the bands at the time of obtaining the band group delay. Although an arbitrary scale can be used as the frequency scale, it is possible to set the frequency scale to have fine intervals in the low-frequency band and to have coarse intervals in the high-frequency band in accordance with hearing characteristics.

Figure 5:
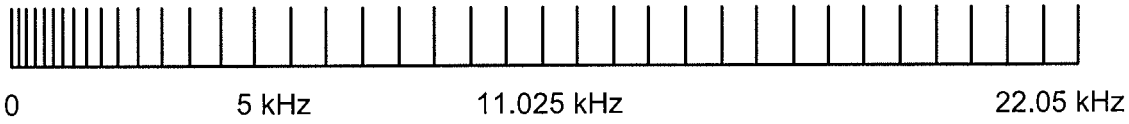
FIG. 5 is a graph illustrating a creation example of a frequency scale.

FIG. 5 is a graph illustrating a creation example of the frequency scale. In the frequency scale illustrated in FIG. 5, a mel-scale of $\alpha=0.35$ is used up to 5 kHz, and the scale is expressed at equal intervals above 5 kHz. In order to enhance reproducibility of the waveform shape, the group delay parameter finely expresses the low-frequency band where the power becomes stronger, and sets the high-frequency band to have coarse intervals. This is because it is difficult to obtain a stable phase parameter in the high-frequency band since the power of the waveform decreases and a random phase component due to the aperiodic component becomes strong. In addition, another reason is that it is known that a phase of the high-frequency band has little influence in terms of hearing.

The control of the random phase component and a component depending on pulse excitation is expressed by intensities of noise components in each band which are intensities of the periodic component and aperiodic component. When speech synthesis is performed using an output result of the speech analyzer 100, a waveform is generated also including a band noise intensity parameter to be described later. Accordingly, here, the phase of the high-frequency band where the noise component is strong is roughly expressed to reduce the order.

Figure 6A:
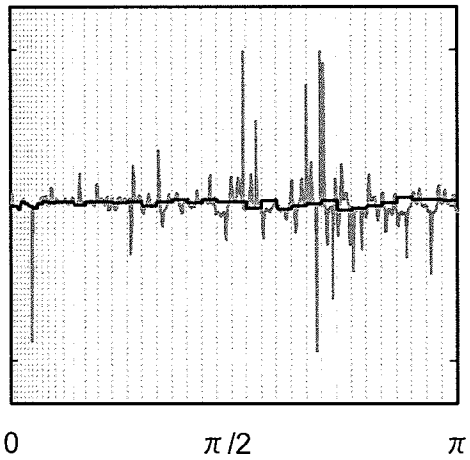
FIGS. 6A, 6B and 6C are graphs exemplifying a result of analysis based on a band group delay parameter.
Figure 6B:
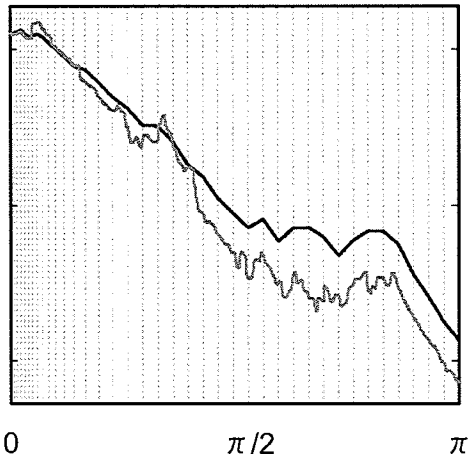
Figure 6C:
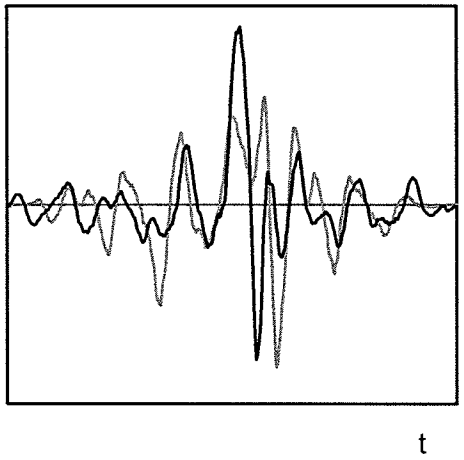

FIGS. 6A, 6B and 6C are graphs exemplifying a result of performing the analysis based on the band group delay parameter using the frequency scale illustrated in FIG. 5. FIG. 6A illustrates the band group delay parameter obtained by the above Formula 3. The band group delay parameter is a weighted average of group delays of each band, and it is understood that it is difficult to reproduce fluctuations that appear in the group delay spectrum with an average group delay.

FIG. 6B is a graph exemplifying a phase generated from the band group delay parameter. In the example illustrated in FIG. 6B, a phase gradient has been almost reproduced, but it is difficult to capture the level different in the phase spectrum, such as the change in phase close to $\pi$ in the low-frequency band, and a portion where the phase spectrum is hardly reproduced is included.

FIG. 6C illustrates an example in which a waveform is generated by performing inverse Fourier transform of the generated phase and the amplitude spectrum generated using the mel-LSP. The generated waveform has a shape significantly different from the waveform as the analysis source, near the center as seen in the waveform of FIG. 3A. In this manner, when the phase is modeled using only the band group delay parameter, it is not possible to capture the level difference of the phase included in the speech, so that a difference is generated between the reproduced waveform and the waveform as the analysis source.

In order to deal with this problem, the speech analyzer 100 uses not only the band group delay parameter but also the band group delay compensation parameter to compensate the phase reconstructed from the band group delay parameter at a predetermined frequency to a phase at the relevant frequency of the phase spectrum.

The band group delay compensation parameter calculation unit 106 calculates the band group delay compensation parameter from the phase spectrum and the band group delay parameter. The band group delay compensation parameter is a parameter to compensate the phase reconstructed from the band group delay parameter to a phase value at a boundary frequency, and is obtained by the following Formula 6 when a difference is used as the parameter.

$$bgrdc(b)=\varphi(\Omega_b)-\dot{\varphi}(\Omega_b) \quad (6)$$

The first term on the right side in the above Formula 6 is a phase at $\Omega_b$ obtained by analyzing the speech. The second term of the above Formula 6 is obtained by using the group delay reconstructed based on a band group delay parameter bgrd(b) and a compensation parameter bgrdc(b). This is expressed as a parameter in which the compensation parameter bgrdc(b) is added at the boundary where $\omega=\Omega_b$ in the group delay of the above Formula 4 as illustrated in the following Formula 7.

$$\hat{\tau}(\omega)=bgrd(b) \ldots (\Omega_b \leq \omega < \Omega_{b+1})$$

$$\hat{\tau}(\omega)=\hat{\tau}(\omega)+bgrdc(b) \ldots (\omega=\Omega_b) \quad (7)$$

A phase based on the group delay configured in this manner is reconstructed using the above Formula 5. In addition, the second term on the right side of the above Formula 6 is obtained using a phase of the following Formula 8 reconstructed based on the band group delay at $\Omega_b$ after reconstructing a phase up to $\omega=\Omega_b-1$ by the above Formulas 7 and 5, and is obtained as a phase reconstructed using the band group delay parameter and the band group delay compensation parameter of the band up to $\Omega_{b-1}$ and the band group delay parameter at $\Omega_b$.

$$\dot{\varphi}(\Omega_b)=\hat{\varphi}(\Omega_b-1)-bgrd(b) \quad (8)$$

In addition, the band group delay compensation parameter is obtained using the above Formula 6 by obtaining the difference between the phase of the second term on the right side and an actual phase, and the actual phase is reproduced at the frequency $\Omega_b$.

Figure 7A:
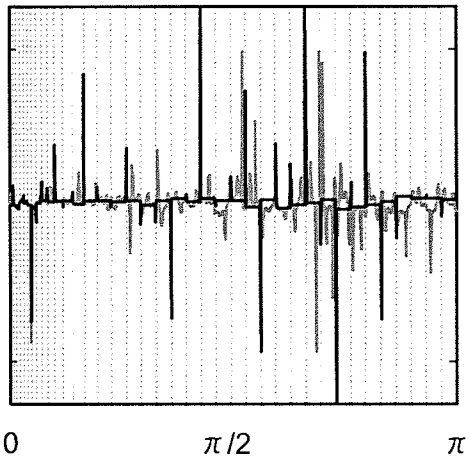
FIGS. 7A, 7B and 7C are graphs exemplifying a result of analysis based on a band group delay compensation parameter.
Figure 7B:
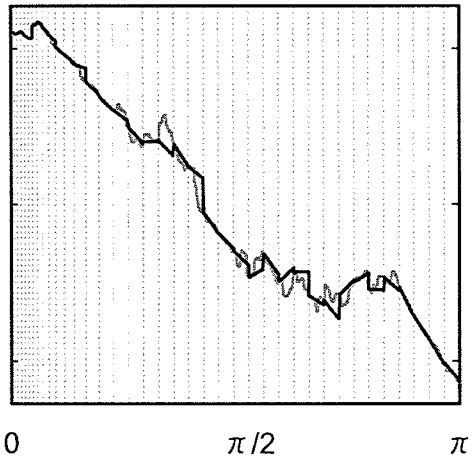
Figure 7C:
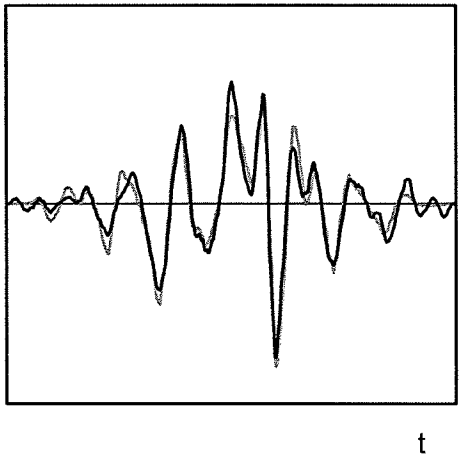

FIGS. 7A, 7B and 7C are graphs exemplifying a result of analysis based on the band group delay compensation parameter. FIG. 7A illustrates a group delay spectrum reconstructed based on the band group delay parameter and the band group delay compensation parameter according to the above Formula 7. FIG. 7B illustrates an example in which a phase is generated from this group delay spectrum. As illustrated in FIG. 7B, the phase close to the actual phase can be reconstructed by using the band group delay compensation parameter. In particular, the phase has been reproduced including even the portion having the stepwise phase where the difference has occurred in FIG. 6B in the low-frequency band part where the interval of the frequency scale is narrow.

FIG. 7C illustrates an example in which a waveform is synthesized based on the phase parameters reconstructed in this manner. Although the waveform shape is significantly different from the waveform as the analysis source in the example illustrated in FIG. 6C, the speech waveform close to the original waveform is generated in the example illustrated in FIG. 7C. Although phase difference information is used here for the compensation parameter bgrdc of the above Formula 6, another parameter such as a phase value at the relevant frequency may be used. For example, any parameter may be used as long as the phase at the relevant frequency can be reproduced by being used in combination with the band group delay parameter.

Figure 8:
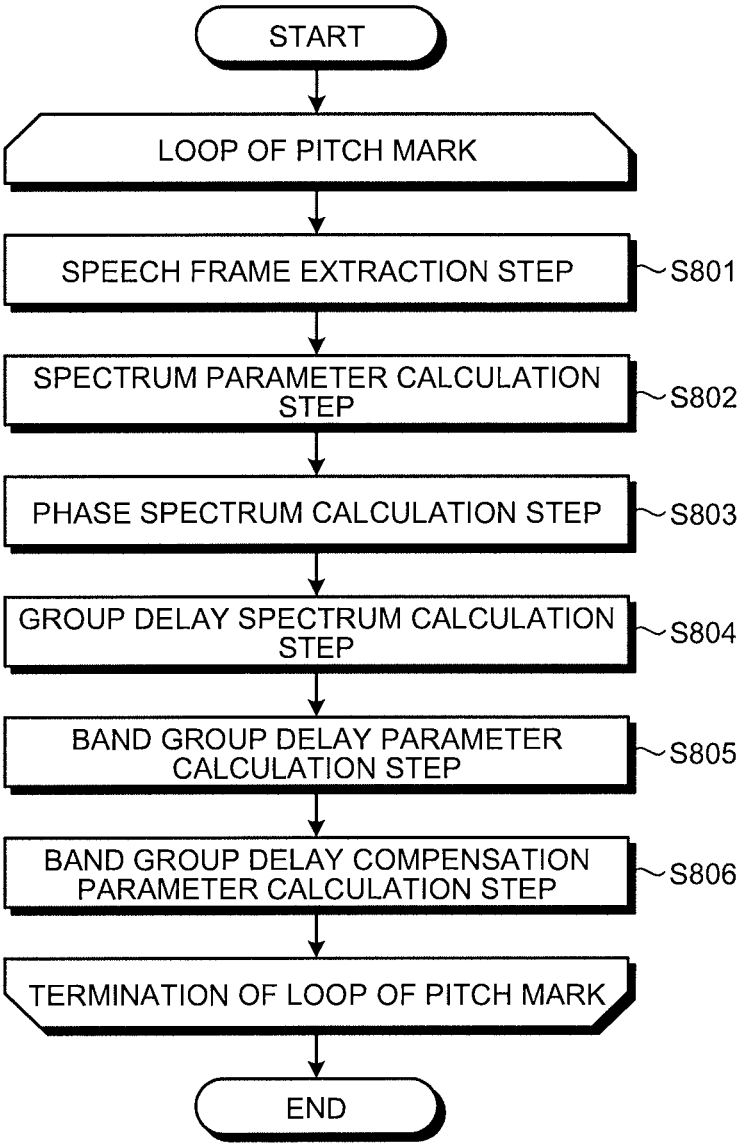
FIG. 8 is a flowchart illustrating processing performed by the speech analyzer.

FIG. 8 is a flowchart illustrating processing performed by the speech analyzer 100. The speech analyzer 100 performs the processing of calculating parameters corresponding to each pitch mark through a loop of a pitch mark. First, the extraction unit 101 in the speech analyzer 100 extracts the speech frame in a speech frame extraction step (S801). Next, the spectrum parameter calculation unit 102 calculates the spectrum parameter in a spectrum parameter calculation step (S802), the phase spectrum calculation unit 103 calculates the phase spectrum in a phase spectrum calculation step (S803), and the group delay spectrum calculation unit 104 calculates the group delay spectrum in a group delay spectrum calculation step (S804).

Figure 9:
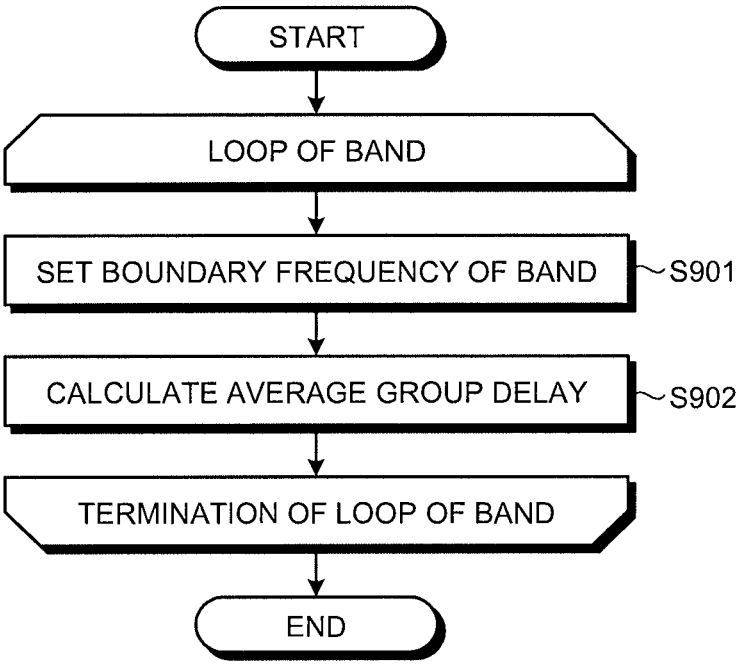
FIG. 9 is a flowchart illustrating details of a band group delay parameter calculation step.

Next, the band group delay parameter calculation unit 105 calculates the band group delay parameter in a band group delay parameter calculation step (S805). FIG. 9 is a flowchart illustrating details of the band group delay parameter calculation step (S805) illustrated in FIG. 8. As illustrated in FIG. 9, the band group delay parameter calculation unit 105 sets a boundary frequency of a band through a loop of each band with a predetermined frequency scale (S901), and calculates the group delay parameter (average group delay) by averaging the group delays using weighting based on the power spectrum or the like as illustrated in the above Formula 3 (S902).

Figure 10:
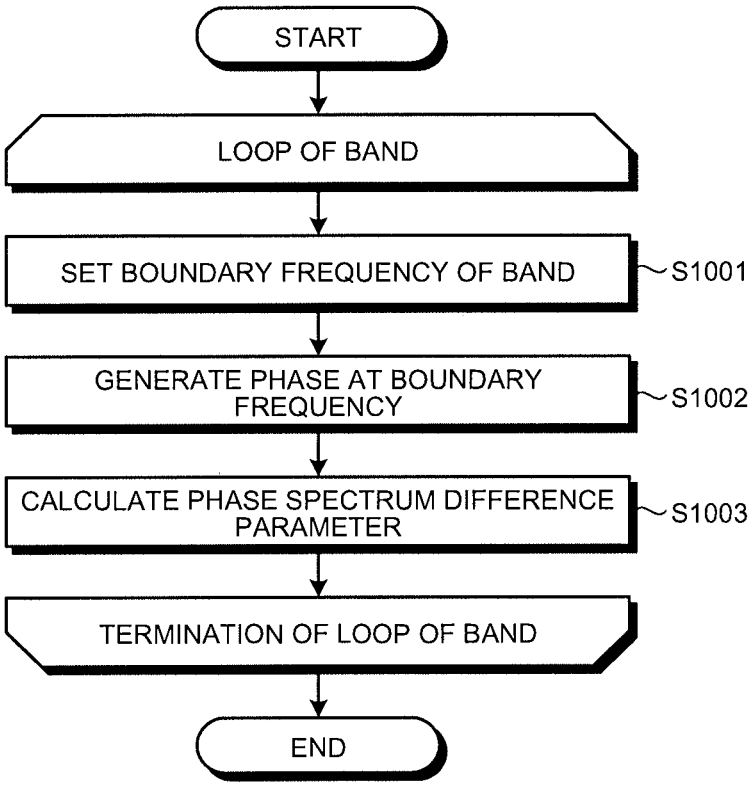
FIG. 10 is a flowchart illustrating details of a band group delay compensation parameter calculation step.

Next, the band group delay compensation parameter calculation unit 106 calculates the band group delay compensation parameter in a band group delay compensation parameter calculation step (S806: FIG. 8). FIG. 10 is a flowchart illustrating details of the band group delay compensation parameter calculation step (S806) illustrated in FIG. 8. As illustrated in FIG. 10, the band group delay compensation parameter calculation unit 106 first sets a boundary frequency of a band through a loop of each band (S1001). Next, the band group delay compensation parameter calculation unit 106 generates a phase at the boundary frequency using the band group delay parameter, and the band group delay compensation parameter of a band equal to or lower than a current band by using the above Formulas 7 and 5 (S1002). Then, the band group delay compensation parameter calculation unit 106 calculates a phase spectrum difference parameter by the above Formula 8, and sets a result of the calculation as the band group delay compensation parameter (S1003).

In this manner, the speech analyzer 100 calculates and outputs the spectrum parameter corresponding to the input speech, the band group delay parameter, and the band group delay compensation parameter by performing the processing illustrated in FIG. 8 (FIGS. 9 and 10). Thus, it is possible to enhance the reproducibility of the speech waveform when performing the speech synthesis.

(Second Speech Processing Device: Speech Synthesizer)

Figure 11:
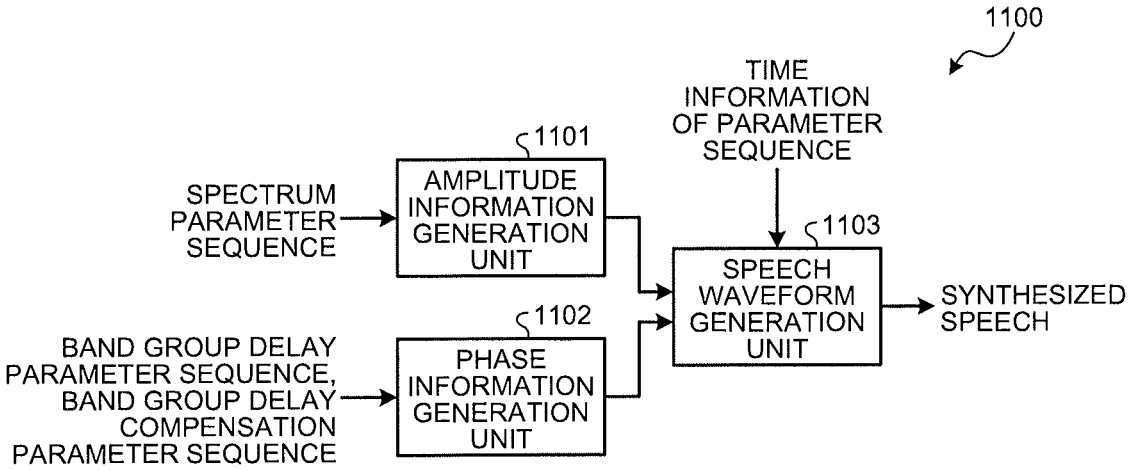
FIG. 11 is a block diagram illustrating a first embodiment of a speech synthesizer.

Next, a second speech processing device according to the embodiment, that is, a speech synthesizer will be described. FIG. 11 is a block diagram illustrating a first embodiment (a speech synthesizer 1100) of the speech synthesizer. As illustrated in FIG. 11, the speech synthesizer 1100 includes an amplitude information generation unit 1101, a phase information generation unit 1102, and a speech waveform generation unit 1103, and generates a speech waveform (synthesized speech) by obtaining a spectrum parameter sequence, a band group delay parameter sequence, a band group delay compensation parameter sequence, and time information of a parameter sequence. Each parameter input to the speech synthesizer 1100 is the parameter calculated by the speech analyzer 100.

The amplitude information generation unit 1101 generates amplitude information from the spectrum parameters at the respective times. The phase information generation unit 1102 generates phase information from the band group delay parameters and the band group delay compensation parameters at the respective times. The speech waveform generation unit 1103 generates the speech waveform according to time information of each parameter based on the amplitude information generated by the amplitude information generation unit 1101 and the phase information generated by the phase information generation unit 1102.

Figure 12:
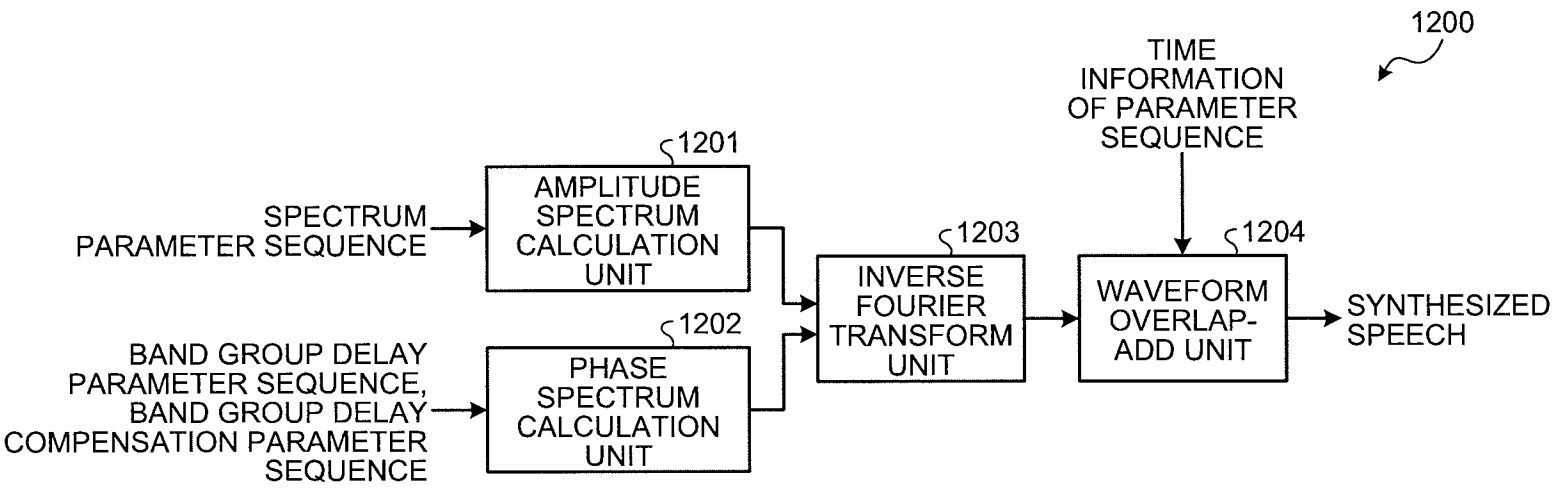
FIG. 12 is a diagram illustrating a configuration example of the speech synthesizer that performs inverse Fourier transform and overlap-addition of waveform.

FIG. 12 is a diagram illustrating a configuration example of a speech synthesizer 1200 that performs inverse Fourier transform and waveform overlap-addition. The speech synthesizer 1200 is one of specific configuration examples of the speech synthesizer 1100, includes an amplitude spectrum calculation unit 1201, a phase spectrum calculation unit 1202, an inverse Fourier transform unit 1203, and a waveform overlap-add unit 1204, and outputs synthesized speech by generating waveforms at the respective times by inverse Fourier transform and synthesizing the generated waveforms to be overlap-added on each other.

More specifically, the amplitude spectrum calculation unit 1201 calculates an amplitude spectrum using the spectrum parameter. For example, when mel-LSP is used as a parameter, the amplitude spectrum calculation unit 1201 checks the stability of the mel-LSP, converts the mel-LSP into a mel-LPC coefficient, and calculates the amplitude spectrum using the mel-LPC coefficient. The phase spectrum calculation unit 1202 calculates a phase spectrum based on the band group delay parameter and the band group delay compensation parameter using the above Formulas 5 and 7.

The inverse Fourier transform unit 1203 performs inverse Fourier transform of the calculated amplitude spectrum and phase spectrum to generate a pitch waveform. The waveform generated by the inverse Fourier transform unit 1203 is exemplified in FIG. 7C. The waveform overlap-add unit 1204 overlap-adds and synthesizes the generated pitch waveforms based on the time information of the parameter sequence to obtain the synthesized speech.

Figure 13A:
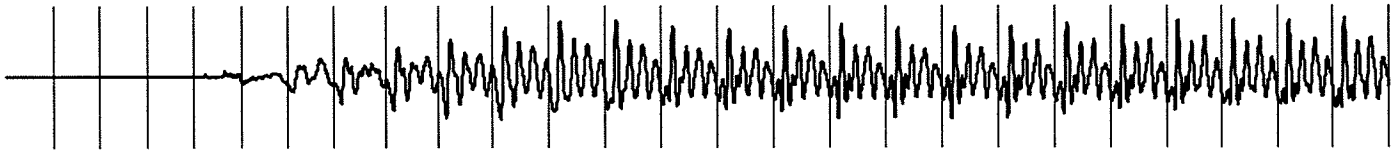
FIGS. 13A, 13B and 13C are graphs illustrating a waveform generation example corresponding to a section illustrated in FIG. 2.
Figure 13B:
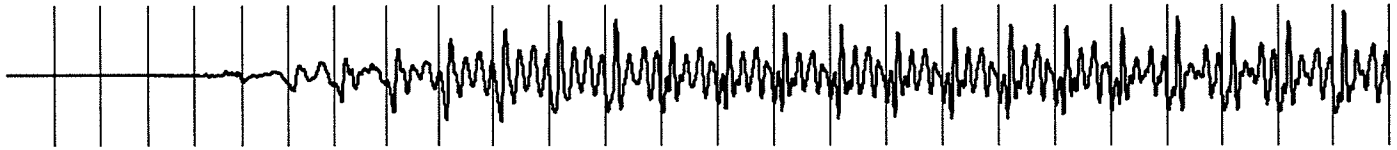
Figure 13C:
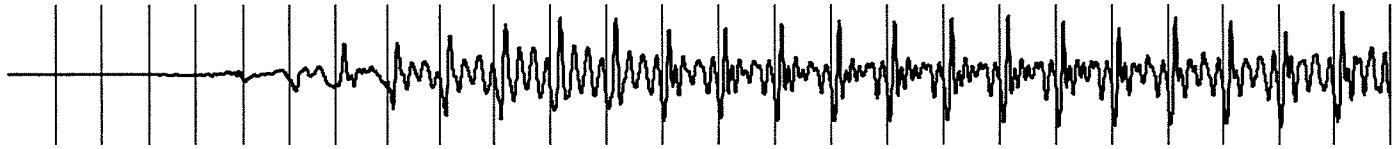

FIGS. 13A, 13B and 13C are graphs illustrating a waveform generation example corresponding to a section illustrated in FIG. 2. FIG. 13A illustrates a speech waveform of the original sound illustrated in FIG. 2. FIG. 13B is a synthesized speech waveform based on the band group delay parameter and the band group delay compensation parameter output from the speech synthesizer 1100 (the speech synthesizer 1200). As illustrated in FIGS. 13A and 13B, the speech synthesizer 1100 can generate the waveform having a shape close to the waveform of the original sound.

FIG. 13C illustrates a synthesized speech waveform in the case of using only the band group delay parameter as a comparative example. As illustrated in FIGS. 13A and 13C, the synthesized speech waveform in the case of using only the band group delay parameter is a waveform having a shape different from that of the original sound.

In this manner, the speech synthesizer 1100 (the speech synthesizer 1200) can reproduce phase characteristics of the original sound by using the band group delay compensation parameter as well as the band group delay parameter, so that it is possible to cause an analyzed and synthesized waveform to approximate to the shape of the speech waveform as the analysis source and to generate a high-quality waveform (enhance the reproducibility of the speech waveform).

Figure 14:
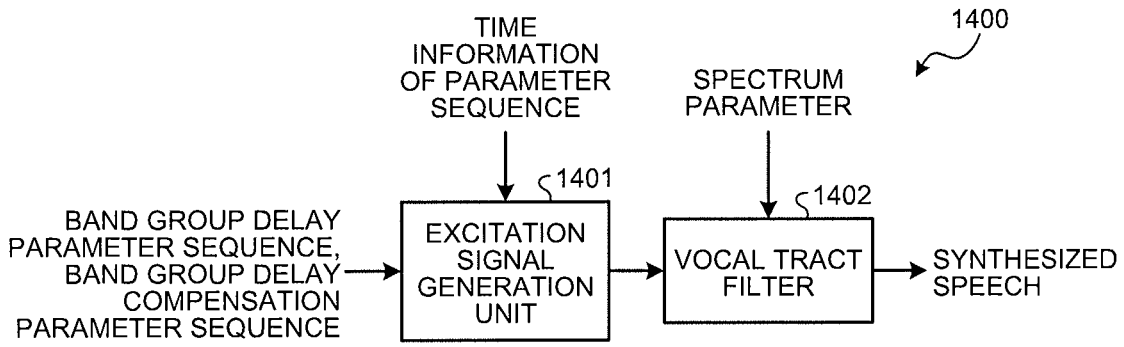
FIG. 14 is a block diagram illustrating a second embodiment of the speech synthesizer.

FIG. 14 is a block diagram illustrating a second embodiment (a speech synthesizer 1400) of the speech synthesizer. The speech synthesizer 1400 includes an excitation signal generation unit 1401 and a vocal tract filter 1402. The excitation signal generation unit 1401 generates an excitation signal using the band group delay parameter sequence, the band group delay compensation parameter sequence, and the time information of the parameter sequence. The excitation signal is a signal which is generated using a noise signal in the unvoiced sound section and using a pulse signal in the voiced sound section when the phase control is not performed and the noise intensity or the like is not usable and has a flat spectrum, and with which a speech waveform can be synthesized by applying a vocal tract filter.

In the speech synthesizer 1400, the excitation signal generation unit 1401 controls a phase of a pulse component based on the band group delay parameter and the band group delay compensation parameter. That is, a phase control function of the phase information generation unit 1102 illustrated in FIG. 11 is performed by the excitation signal generation unit 1401. That is, the speech synthesizer 1400 rapidly generates the waveform by using the band group delay parameter and the band group delay compensation parameter for waveform generation of a vocoder type.

Figure 15:
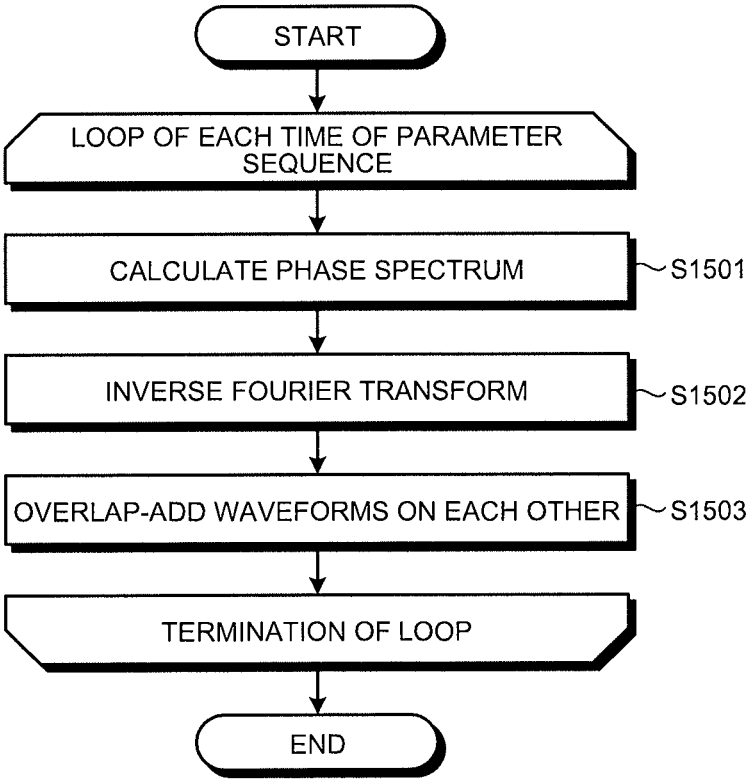
FIG. 15 is a flowchart illustrating processing performed by a excitation signal generation unit.

One of methods of phase-controlling the excitation signal is a method of using the inverse Fourier transform. In this case, the excitation signal generation unit 1401 performs processing illustrated in FIG. 15. That is, the excitation signal generation unit 1401 calculates a phase spectrum based on the band group delay parameter and the band group delay compensation parameter by using the above Formulas 5 and 7 at each time of the feature parameters (S1501), performs the inverse Fourier transform with an amplitude as one (S1502), and overlap-adds the generated waveforms on each other (S1503).

The vocal tract filter 1402 applies a filter defined using the spectrum parameter to the generated excitation signal to perform the waveform generation and output the speech waveform (synthesized speech). The vocal tract filter 1402 has a function provided in the amplitude information generation unit 1101 illustrated in FIG. 11 in order to control the amplitude information.

When the phase control is performed as described above, the speech synthesizer 1400 can generate the waveform from the excitation signal but includes the processing of inverse Fourier transform. Thus, the processing amount increases more than that of the speech synthesizer 1200 (FIG. 12) because the filter operation is included, and it is difficult to generate the waveform rapidly. Thus, the excitation signal generation unit 1401 is configured as illustrated in FIG. 16 so as to generate a excitation signal that is phase-controlled only by processing in the time domain.

Figure 16:
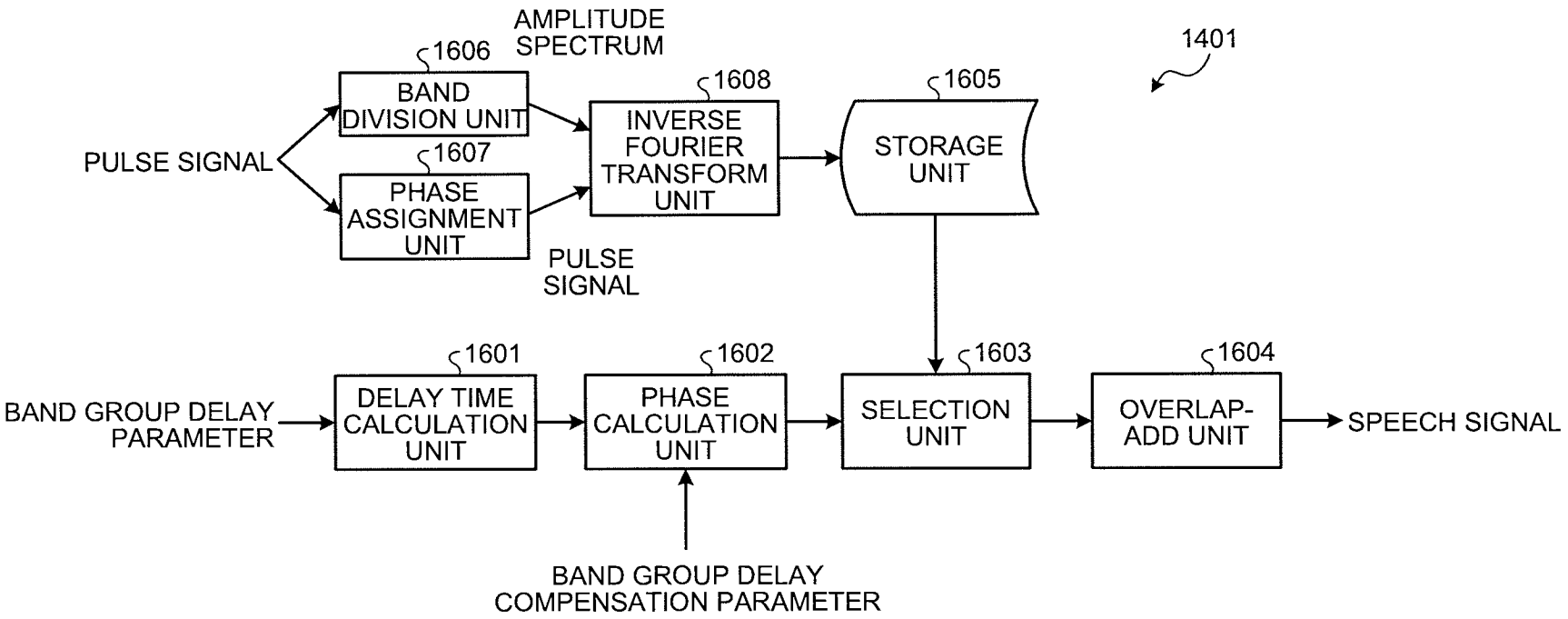
FIG. 16 is a block diagram illustrating a configuration of the excitation signal generation unit.

FIG. 16 is a block diagram illustrating a configuration of the excitation signal generation unit 1401 that generates the excitation signal that is phase-controlled only by the processing in the time domain. The excitation signal generation unit 1401 illustrated in FIG. 16 prepares, in advance, a phase shift band pulse signal obtained by performing band division of a phase-shifted pulse signal, delays the phase shift band pulse signals, and synthesizes the delayed phase shift band pulse signal to be overlap-added on each other, thereby generating a excitation waveform.

Specifically, the excitation signal generation unit 1401 first shifts a phase of a pulse signal and stores the signal of each band obtained by band division in the storage unit

1605. The phase shift band pulse signal is a signal obtained by setting an amplitude spectrum in a corresponding band as one and a phase spectrum as a constant value, and is created using the following Formula 9 as the signal of each band obtained by band division after shifting the phase of the pulse signal.

$$|X(\omega)| = \begin{cases} 1 & \ldots \quad (\Omega_b \le \omega < \Omega_{b+1}) \\ 0 & \ldots \quad \text{otherwise} \end{cases}, \qquad (9)$$

$$\arg(X(\omega)) = \varphi \ \ldots \ (0 \le \varphi \le 2\pi)$$

Here, the band boundary $\Omega_b$ is determined depending on the frequency scale, and a phase $\psi$ is quantized in a range of $0 \le \psi < 2\pi$ and quantized in P levels. In the case of P=128, band pulse signals of 128×the number of bands are created in increments of $2\pi/128$. In this manner, the phase shift band pulse signal is obtained by band division of the phase-shifted pulse signal, and is selected based on principal values of a band and a phase at the time of synthesis. The phase shift band pulse signal created in this manner is expressed as $\text{bandpulse}_b^{ph(b)}$ (t) when a phase shift index of a band b is ph(b).

Figure 17:
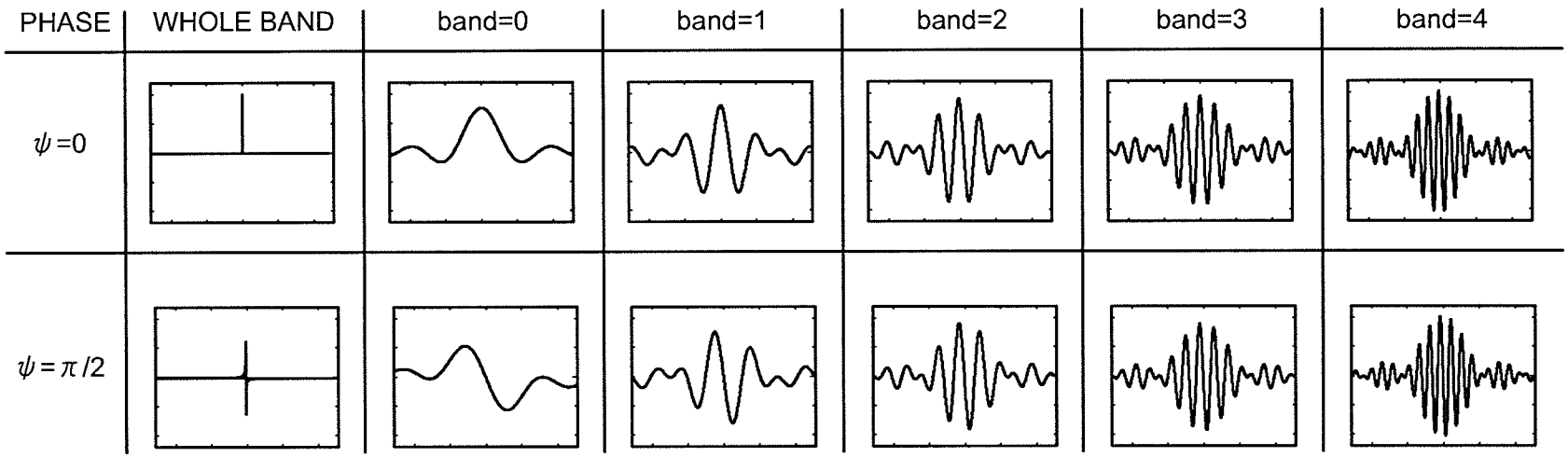
FIG. 17 is a view illustrating a phase shift band pulse signal.

FIG. 17 is a view illustrating the phase shift band pulse signal. The left field is the phase-shifted pulse signal of the whole band, the upper row illustrates the case of a zero phase, and the lower row illustrates the case of the phase $\psi=\pi/2$. The second to sixth columns illustrate band pulse signals up to the fifth band from the low-frequency band with the scale illustrated in FIG. 5, respectively. In this manner, a storage unit 1605 stores a phase shift band pulse signal created by a band division unit 1606, the phase assignment unit 1607, and an inverse Fourier transform unit 1608.

A delay time calculation unit 1601 calculates a delay time in each band of the phase shift band pulse signal from the band group delay parameter. The band group delay parameter obtained by the above Formula 3 represents an average delay time of a band in the time domain, and is converted into an integer of a delay time delay(b) by the following formula 10, and a group delay corresponding to the integer delay time is obtained as $\tau_{int}$(b).

$$\text{delay}(b) = \text{int}\left(\frac{fftSize}{2\pi} bgrd(b)\right) \qquad (10)$$

$$bgrd_{int}(b) = \frac{2\pi}{fftSize}\text{delay}(b)$$

A phase calculation unit 1602 calculates a phase at the boundary frequency from the band group delay parameter and the band group delay compensation parameter of a band that is lower than a band to be obtained. The phase at the boundary frequency to be reconstructed from the parameters is $\psi(\Omega_b)$ that is obtained by the above Formula 7 and Formula 5. A selection unit 1603 calculates a phase of a pulse signal of each band using the boundary frequency phase and an integer group delay $\text{bgrd}_{int}$(b). This phase is obtained by the following Formula 11 as a y-intercept of a straight line passing through $\psi(\Omega_b)$ with a gradient of $\text{bgrd}_{int}$(b).

$$\text{phase}(b) = \varphi(\Omega_b) + \Omega_b \cdot \tau_{int}(b) \qquad (11)$$

In addition, the selection unit 1603 obtains a principal value of the phase obtained by the above Formula 11 by performing addition or subtraction of $2\pi$ to fall within a range of ($0 \le \text{phase(b)} < 2\pi$) (which will be described as <phase(b)>), and a phase number ph(b) is obtained by quantizing the obtained principal value of the phase at the time of generating the phase shift band pulse signal (the following Formula 12).

$$\text{ph}(b) = \text{int}\left(\frac{P}{2\pi}\langle\text{phase}(b)\rangle\right) \qquad (12)$$

The selection of the phase shift band pulse signal based on the band group delay parameter and the band group delay compensation parameter is performed using this ph(b).

Figure 18:
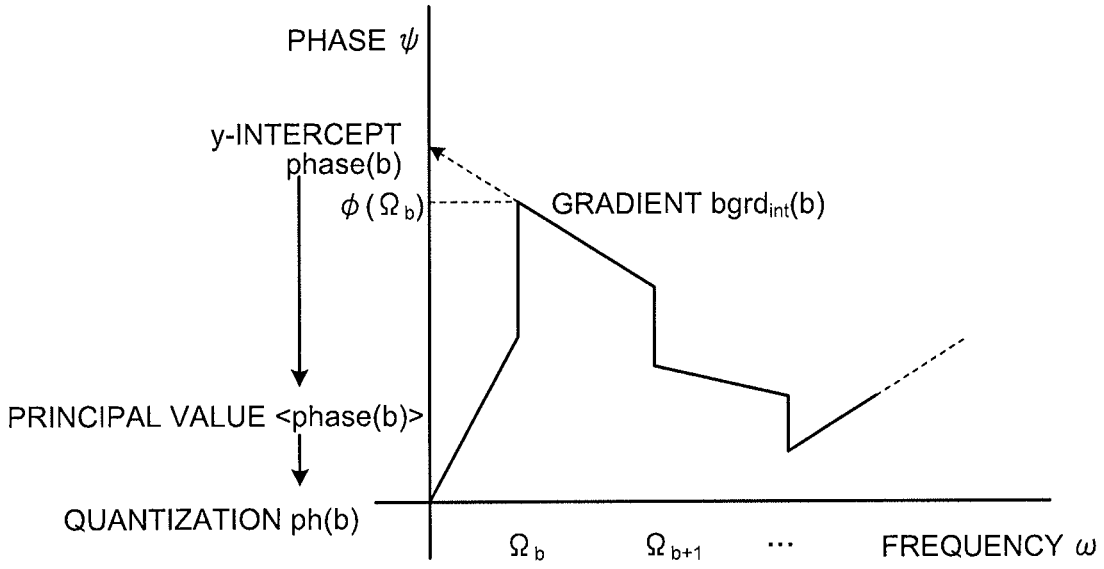
FIG. 18 is a conceptual graph illustrating a selection algorithm for selection performed by a selection unit.

FIG. 18 is a conceptual graph illustrating a selection algorithm for selection performed by the selection unit 1603. Here, an example of selection of a phase shift band pulse signal corresponding to a excitation signal in a band of b=1 is illustrated. In order to generate a excitation signal of $\Omega_{b+1}$ from the band $\Omega_b$, the selection unit 1603 obtains the group delay $\text{bgrd}_{int}$(b) which is the delay, obtained by converting the band group delay parameter of the band into the integer, and the phase gradient. Then, the selection unit 1603 obtains the y-intercept phase(b) of the straight line with the gradient $\text{bgrd}_{int}$(b) that passes through the phase $\psi(\Omega_b)$ at the boundary frequency generated from the band group delay parameter and the band group delay compensation parameter, and selects the phase shift band pulse signal based on the phase number ph(b) obtained by quantizing the principal value <phase(b)>.

Figure 19A:
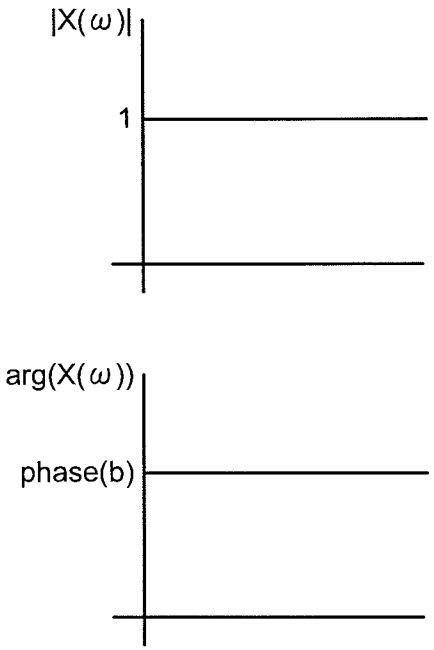
FIGS. 19A, 19B and 19C are graphs illustrating a phase shift band pulse signal.
Figure 19B:
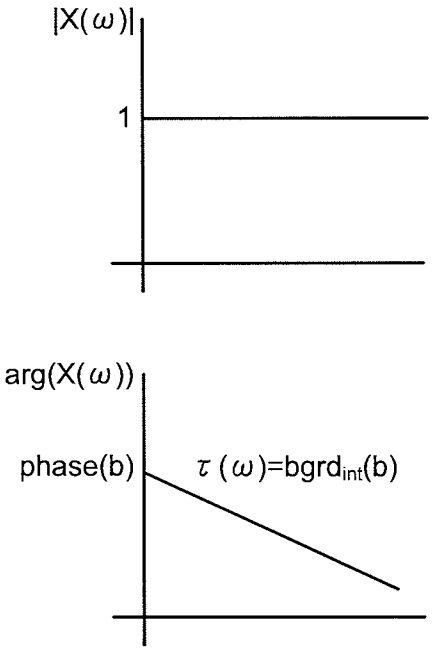
Figure 19C:
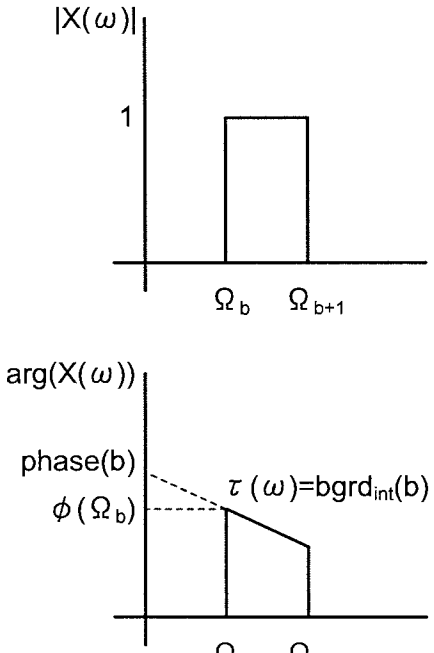

FIGS. 19A, 19B and 19C are graphs illustrating the phase shift band pulse signal. A pulse signal of the entire band based on the phase phase(b) is a signal having a fixed phase phase(b) and an amplitude of one as illustrated in FIG. 19A. When a delay in the time direction is applied, a straight line with the gradient $\text{bgrd}_{int}$(b) that passes through the y-intercept phase(b) is obtained as illustrated in FIG. 19B since a fixed group delay corresponding to the delay amount occurs. FIG. 19C is obtained by applying a band-pass filter to the signal having the linear phase in the entire band and cutting off a section of $\Omega_b$ to $\Omega_{b+1}$, and represents a signal in which an amplitude is one in the section of $\Omega_b$ to $\Omega_{b+1}$ and zero in the other frequency region and a phase at the boundary $\Omega_b$ is $\psi(\Omega_b)$.

Thus, it is possible to appropriately select the phase shift pulse signal of each band by the method illustrated in FIG. 18. The overlap-add unit 1604 delays the phase shift band pulse signal selected in this manner by the delay time delay(b) obtained by the delay time calculation unit 1601, and adds waveforms of the phase shift band pulse signal over the entire band, thereby generating a excitation signal reflecting the band group delay parameter and the band group delay compensation parameter.

$$\text{excitation}(t) = \sum_{b=0}^{B} bandpulse_b^{ph(b)}(t + \text{delay}(b)) \qquad (13)$$

Figure 20A:
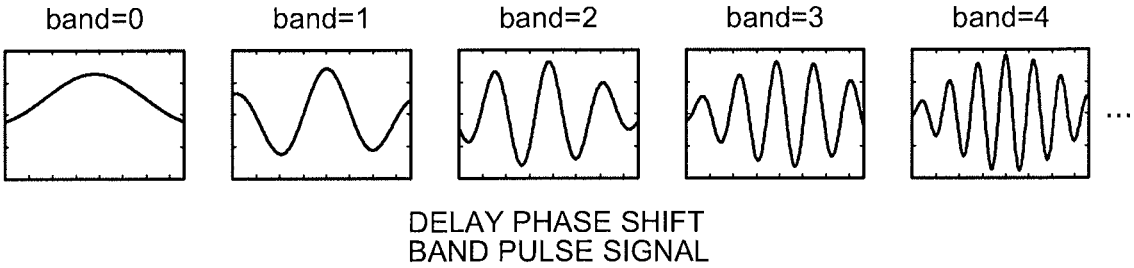
FIGS. 20A, 20B, 20C and 20D are graphs illustrating a generation example of a excitation signal.
Figure 20B:
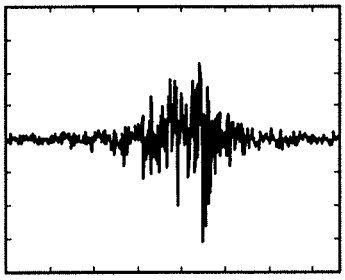
Figure 20C:
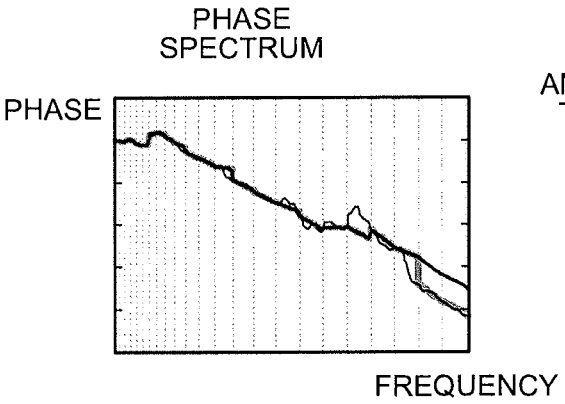
Figure 20D:
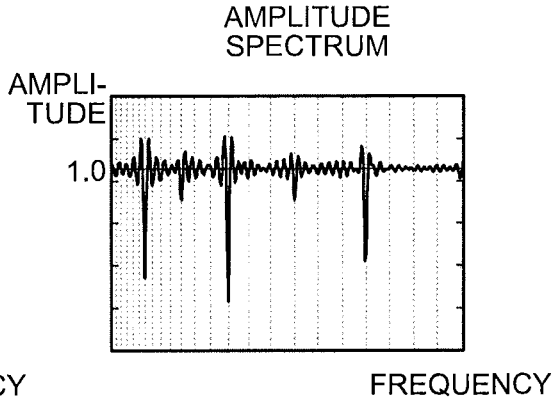

FIGS. 20A, 20B, 20C and 20D are graphs illustrating a generation example of the excitation signal. FIG. 20A illustrates a excitation signal of each band, and illustrates a waveform obtained by delaying the selected phase shift pulse signal in five low-frequency bands. A excitation signal generated by adding these waveforms over the entire band is illustrated in FIG. 20B. A phase spectrum of the signal generated in this manner is illustrated in FIG. 20C and an amplitude spectrum thereof is illustrated in FIG. 20D.

In the phase spectrum illustrated in FIG. 20C, a phase of the analysis source is indicated by a thin line, and phases generated by Formulas 5 and 7 are indicated by bold lines in an overlapping manner. In this manner, the phase generated by the excitation signal generation unit 1401 and the phases regenerated from the parameters substantially overlap each other, except for portions having gaps caused by differences in unwrapping high-frequency phase, and a phase close to the phase of the analysis source is generated.

When viewing the amplitude spectrum illustrated in FIG. 20D, it is understood that a shape close to a flat spectrum with the amplitude of approximately 1.0 is obtained except for portions where the phase change greatly exceeds a zero point, and the excitation waveform is correctly generated. The excitation signal generation unit 1401 synthesizes the excitation signals generated in this manner to be overlap-added on each other according to the pitch mark determined by the parameter sequence time information, and generates an excitation signal of the whole sentence.

Figure 21:
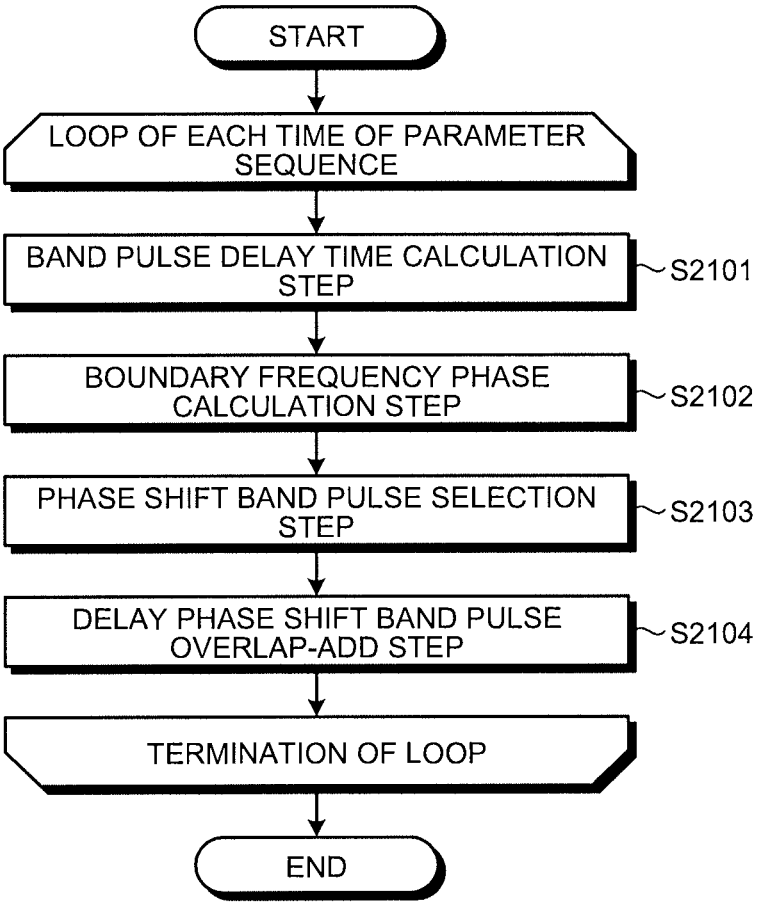
FIG. 21 is a flowchart illustrating processing performed by the excitation signal generation unit.

FIG. 21 is a flowchart illustrating processing performed by the excitation signal generation unit 1401. The excitation signal generation unit 1401 performs a loop at each time of the parameter sequence to calculate a delay time using the above Formula 10 in a band pulse delay time calculation step (S2101) and calculate the phase of the boundary frequency using the above Formulas 5 and 7 in a boundary frequency phase calculation step (S2102). The excitation signal generation unit 1401 selects the phase shift band pulse signal included in the storage unit 1605 using the above Formulas 11 and 12 in a phase shift band pulse selection step (S2103), and generates the excitation signal by delaying the selected phase shift band pulse signal and overlap-adding the delayed phase shift band pulse signals in a delay phase shift band pulse overlap-add step (S2104).

The vocal tract filter 1402 applies the vocal tract filter to the excitation signal generated by the excitation signal generation unit 1401 to obtain synthesized speech. In the case of mel-LSP parameters, the vocal tract filter converts the mel-LSP parameters into mel-LPC parameters, and generates the waveform by applying a mel-LPC filter after performing gain bundling processing and the like.

Since a minimum phase characteristic is added due to the influence of the vocal tract filter, a process of correcting a minimum phase may be applied when obtaining the band group delay parameter and the band group delay compensation parameter from the phase of the analysis source. The minimum phase is generated on an imaginary axis by generating an amplitude spectrum from mel-LSP, performing inverse Fourier transform on a logarithmic amplitude spectrum of a spectrum based on a zero phase, and performing Fourier transform on the obtained cepstrum again such that a positive component becomes twice and a negative component becomes zero.

The correction of the minimum phase is performed by unwrapping the phase obtained in this manner, and subtracting a waveform from the analyzed phase. A band group delay parameter and a band group delay compensation parameter are obtained from a phase spectrum obtained by the minimum phase correction, a excitation is generated by the above-described processing of the excitation signal generation unit 1401, and the filter is applied, thereby obtaining the synthesized speech reproducing the phase of the original waveform.

Figure 22A:
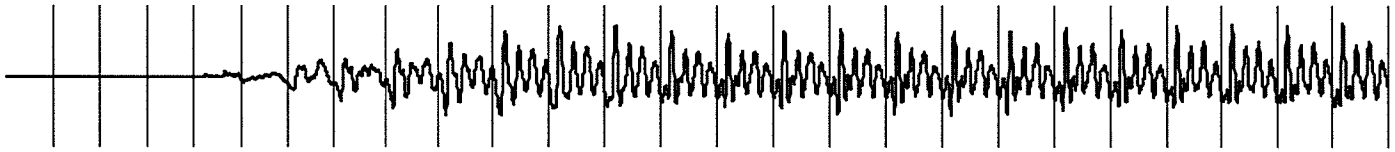
FIGS. 22A, 22B and 22C are graphs exemplifying a speech waveform generated by vocoder of the embodiment also including minimum phase vocoder.
Figure 22B:
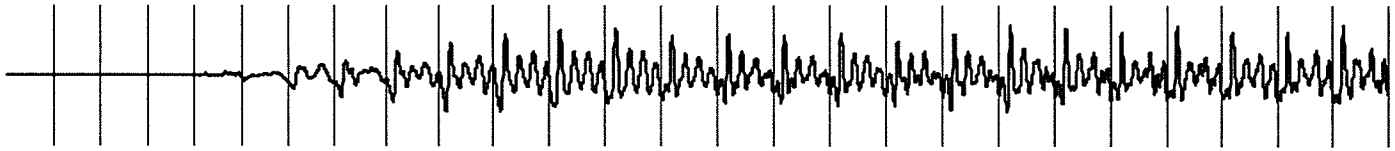
Figure 22C:
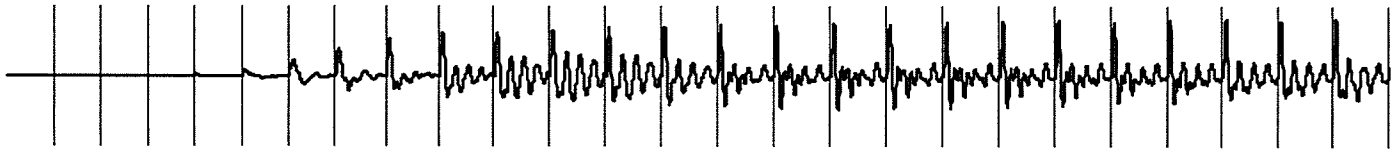

FIGS. 22A, 22B and 22C are graphs exemplifying a speech waveform generated also including the minimum phase correction. FIG. 22A is the speech waveform as the analysis source which is the same as that in FIG. 13A. FIG. 22B is an analyzed and synthesized waveform based on vocoder-type waveform generation performed by the speech synthesizer 1400. FIG. 22C is a waveform of a minimum phase in the case of a vocoder based on a widely-used pulse excitation.

The analyzed and synthesized waveform generated by the speech synthesizer 1400 illustrated in FIG. 22B reproduces a waveform close to the original sound illustrated in FIG. 22A. In addition, the speech waveform is generated to be also close to the waveform illustrated in FIG. 13B. On the other hand, a sound waveform is formed with power focused in the vicinity of the pitch mark with the minimum phase illustrated in FIG. 22C, and it is difficult to reproduce the shape of the speech waveform of the original sound.

In addition, a processing time in the case of generating a speech waveform of about 30 seconds was measured in order to compare the throughput. A processing time excluding initial setting such as phase shift band pulse generation was about 9.19 seconds in the case of the configuration in FIG. 12 using the inverse Fourier transform, and was about 0.47 seconds (measured by a calculation server of a CPU at 2.9 GHz) in the case of the configuration in FIG. 14 of the vocoder type. That is, it was confirmed that the processing time was shortened to about 5.1%. That is, it is possible to generate the waveform rapidly by the vocoder-type waveform generation.

This is because it is possible to generate the waveform reflecting phase characteristics only with the operation in the time domain without using the inverse Fourier transform. Although the excitation is generated and the filter is applied after overlap-adding and synthesizing the excitation waveforms in the above-described waveform generation, the invention is not limited thereto. A different configuration may be adopted in which a excitation waveform is generated for each pitch waveform and is subjected to a filter to generate the pitch waveforms, and the generated pitch waveforms are synthesized to be overlap-added on each other. Then, an excitation signal may be generated from the band group delay parameter and the band group delay compensation parameter using the excitation signal generation unit 1401 based on the phase shift band pulse signal illustrated in FIG. 16.

Figure 23:
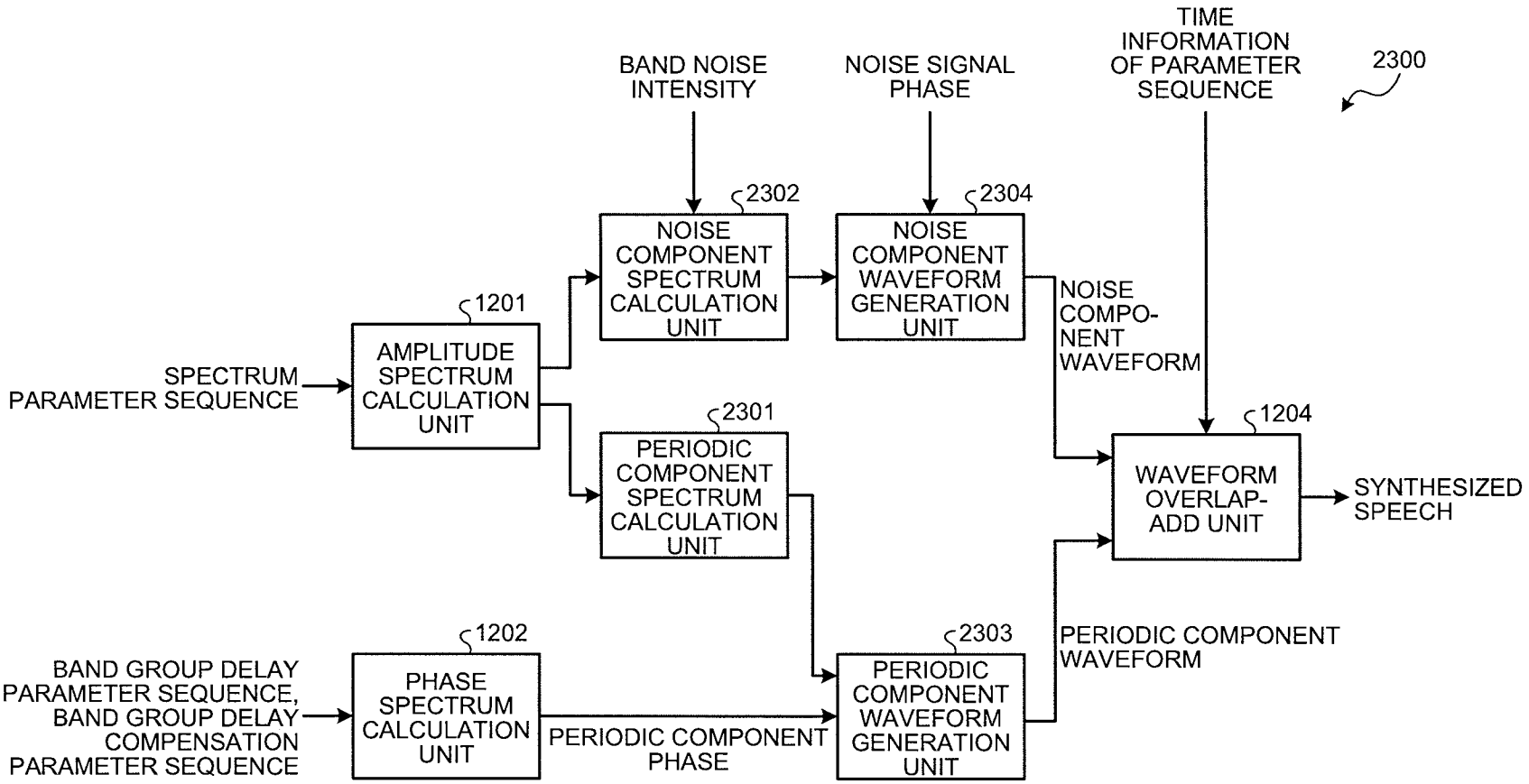
FIG. 23 is a diagram illustrating a configuration example of a speech synthesizer using a band noise intensity.

FIG. 23 is a diagram illustrating a configuration example of a speech synthesizer 2300 obtained by adding control by separation of a noise component and a periodic component using a band noise intensity to the speech synthesizer 1200 illustrated in FIG. 12. The speech synthesizer 2300 is one specific configuration of the speech synthesizer 1100 in which the amplitude spectrum calculation unit 1201 calculates an amplitude spectrum from the spectrum parameter sequence, and a periodic component spectrum calculation unit 2301 and a noise component spectrum calculation unit 2302 separate the amplitude spectrum into a periodic component spectrum and a noise component spectrum according to the band noise intensity. The band noise intensity is a parameter representing a ratio of noise components in each band of a spectrum, and can be obtained, for example, by a method of separating speech into periodic components and noise components using a pitch scaled harmonic filter (PSHF) method, and obtaining a noise component ratio at each frequency, and averaging the obtained ratios for each predetermined band, or the like.

Figure 24A:
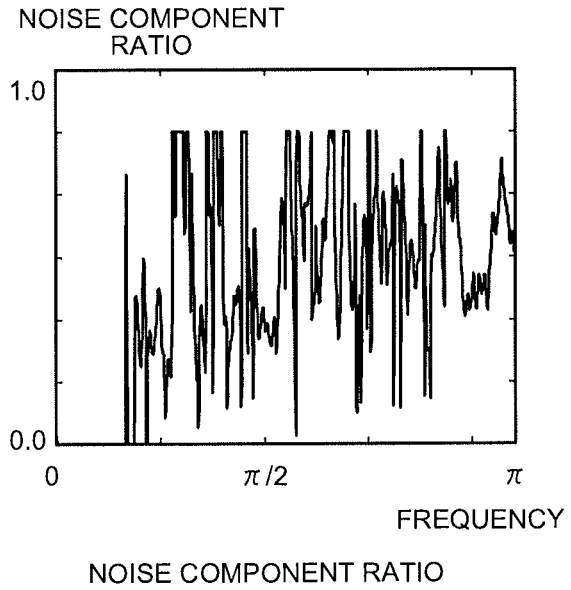
FIGS. 24A and 24B are graphs exemplifying the band noise intensity.
Figure 24B:
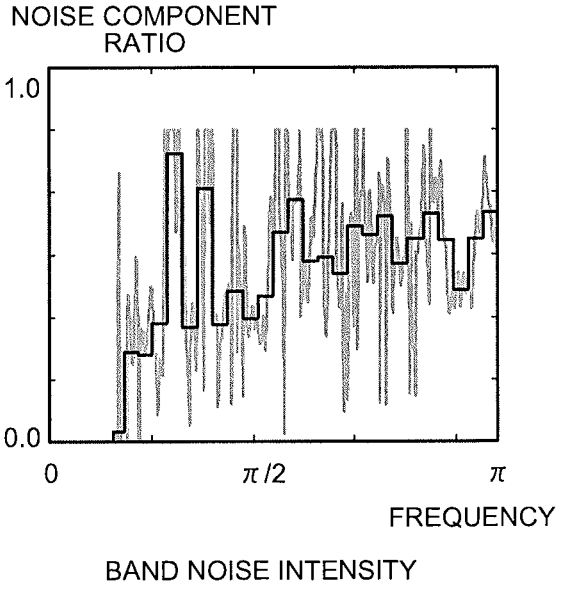

FIGS. 24A and 24B are graphs exemplifying the band noise intensity. FIG. 24A illustrates a ratio $ap(\omega)$ of aperiodic components at each frequency that is obtained by acquiring a spectrum of speech of a processing target frame and a spectrum of the aperiodic components from signals generated by separating the speech into periodic components and aperiodic components by the PSHF. At the time of processing, post-processing of setting the ratio according to the PSHF to zero in the band of voiced sound, processing of clipping the ratio between zero and one, or the like is added. A band noise intensity bap(b) illustrated in FIG. 24B is a weighted average of the spectrum according to a frequency scale using the noise component ratios obtained in this manner. The scale illustrated in FIG. 5 is used as the frequency scale similarly to the band group delay, and is obtained by the following Formula 14.

$$bap(b) = \frac{\sum_{\omega=\Omega_b}^{\Omega_{b+1}} ap(\omega)|S(\omega)|^2}{\sum_{\omega=\Omega_b}^{\Omega_{b+1}} |S(\omega)|^2} \tag{14}$$

The noise component spectrum calculation unit 2302 multiplies the spectrum generated from the spectrum parameter by the noise intensity at each frequency based on the band noise intensity to obtain the noise component spectrum. The periodic component spectrum calculation unit 2301 calculates the periodic component spectrum from which the noise component spectrum has been eliminated by multiplying the noise component spectrum by 1.0-bap(b).

The noise component waveform generation unit 2304 generates the noise component waveform by performing inverse Fourier transform of an amplitude spectrum based on a random phase generated from a noise signal and the noise component spectrum. A noise component phase can be created, for example, by generating Gaussian noise having an average of zero and a dispersion of one, cutting out the generated noise with the Hanning window with twice the length of a pitch, and performing Fourier transform of the windowed Gaussian noise thus cut out.

The periodic component waveform generation unit 2303 generates a periodic component waveform by performing inverse Fourier transform of an amplitude spectrum based on the phase spectrum calculated from the band group delay parameter and the band group delay compensation parameter by the phase spectrum calculation unit 1202 and the periodic component spectrum.

The waveform overlap-add unit 1204 adds the generated noise component waveform and periodic component waveform to be overlap-added on each other according to the time information of the parameter sequence, thereby obtaining a synthesized speech.

In this manner, it is possible to separate a random phase component which is hardly expressed as the band group delay parameter and generate the noise component from the random phase by separating the noise component and the periodic component. As a result, it is possible to suppress the noise components included in the unvoiced sound section, a high-frequency band of a voiced fricative sound, and the voiced sound, from becoming a pulsed buzzy sound quality. In particular, when the respective parameters are statistically modeled, the average value tends to approach zero and approach a pulsed phase component if the band group delay and band group delay compensation parameters obtained from a plurality of random phase components are averaged. As the band noise intensity is used together with the band group delay parameter and the band group delay compensation parameter, it is possible to generate the noise component from the random phase, the properly generated phase can be used for the periodic component, and the sound quality of synthesized speech improves.

Figure 25:
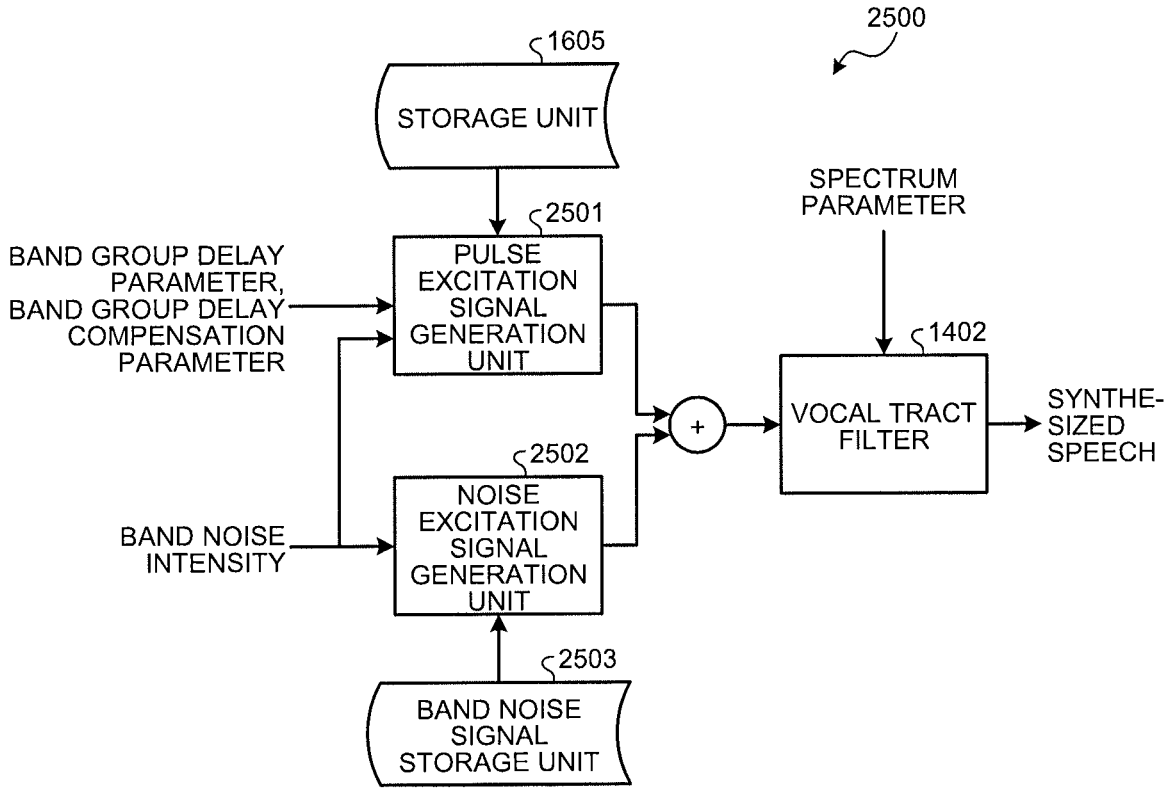
FIG. 25 is a diagram illustrating a configuration example of a speech synthesizer also using control based on the band noise intensity.

FIG. 25 is a diagram illustrating a configuration example of a vocoder type speech synthesizer 2500 to realize fast waveform generation also using control based on a band noise intensity. Excitation generation based on a noise component is performed by using a band noise signal having a fixed length which is divided into bands in advance and included in a band noise signal storage unit 2503. In the speech synthesizer 2500, the band noise signal storage unit 2503 stores the band noise signal, and a noise excitation signal generation unit 2502 controls an amplitude of a band noise signal of each band according to the band noise intensity and adds the amplitude-controlled band noise signal to generate a noise excitation signal. The speech synthesizer 2500 is a modification of the speech synthesizer 1400 illustrated in FIG. 14.

A pulse excitation signal generation unit 2501 uses the phase shift band pulse signal stored in the storage unit 1605 to generate a excitation signal phase-controlled by the configuration illustrated in FIG. 16. However, when overlap-adding the delayed phase shift band pulse waveform, the amplitude of the signal of each band is controlled using the band noise intensity to generate the signal having an intensity of (1.0-bap(b)). The speech synthesizer 2500 adds the pulse excitation signal and noise excitation signal generated in this manner to generate a excitation signal, and applies the vocal tract filter based on the spectrum parameters in the vocal tract filter 1402 to obtain synthesized speech.

The speech synthesizer 2500 can synthesize speech having a shape close to a shape of an analysis source waveform by generating each of a noise signal and a periodic signal, suppressing the occurrence of pulsed noise with respect to the noise component, and adding the phase controlled periodic component and noise component to generate the excitation, which is similar to the speech synthesizer 2300 illustrated in FIG. 23. In addition, since the speech synthesizer 2500 can calculate both the generation of the noise excitation and the generation of the pulse excitation only by the processing in the time domain, it is possible to perform fast waveform generation.

In this manner, the band group delay parameter and the band group delay compensation parameter are used in the first embodiment and the second embodiment of the speech synthesizer, so that it is possible to improve the degree of similarity between the reconstructed phase and the phase obtained by analyzing the waveform with the feature parameters reduced in dimension that can be statistically modeled, and it is possible to perform the speech synthesis properly phase-controlled based on these parameters. The respective speech processing devices according to the embodiments make it possible to generate the waveform rapidly while enhancing the reproducibility of the waveform by using the band group delay parameter and the band group delay compensation parameter. Further, in the vocoder-type speech synthesizer, it is possible to generate the phase-controlled waveform rapidly by generating the excitation waveform phase-controlled only by processing in the time domain and enabling the waveform generation using the vocal tract filter. In addition, as the band group delay parameter and the band group delay compensation parameter are used in combination with the band noise intensity parameter in the speech synthesizer, the reproducibility of the noise component is also improved, and it is possible to perform the higher-quality speech synthesis.

Figure 26:
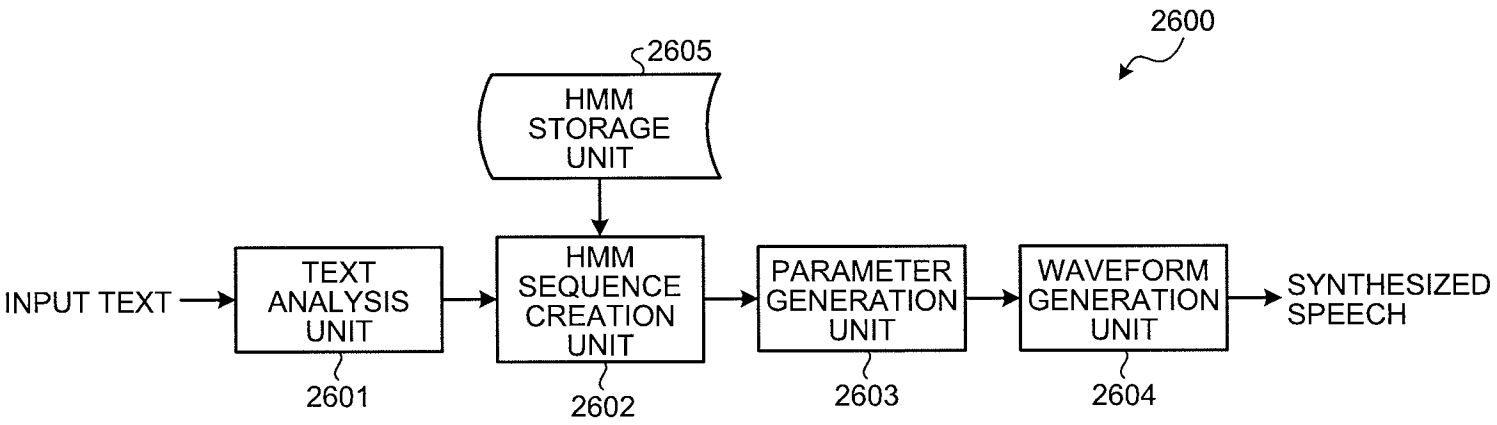
FIG. 26 is a block diagram illustrating a third embodiment of the speech synthesizer.

FIG. 26 is a block diagram illustrating a third embodiment (a speech synthesizer 2600) of the speech synthesizer. The speech synthesizer 2600 is obtained by applying the above-described band group delay parameter and band group delay compensation parameter to a text-to-speech synthesizer. Here, as a text-to-speech synthesis method, the band group delay parameter and the band group delay compensation parameter are used as feature parameters in speech synthesis based on a hidden Markov model (HMM) which is a speech synthesis technique based on a statistical model.

The speech synthesizer 2600 includes a text analysis unit 2601, an HMM sequence creation unit 2602, a parameter generation unit 2603, a waveform generation unit 2604, and an HMM storage unit 2605. The HMM storage unit (a statistical model storage unit) 2605 stores an HMM trained from acoustic feature parameters including the band group delay parameter and the band group delay compensation parameter.

The text analysis unit 2601 analyzes input text to obtain information such as pronunciation and accent and creates context information. The HMM sequence creation unit 2602 creates an HMM sequence corresponding to the input text based on the HMM model stored in the HMM storage unit 2605 according to the context information created from the text. The parameter generation unit 2603 generates the acoustic feature parameters based on the HMM sequence. The waveform generation unit 2604 generates a speech waveform based on the generated feature parameter sequence.

More specifically, the text analysis unit 2601 creates the context information based on language analysis of the input text. The text analysis unit 2601 performs morphological analysis on the input text to obtain language information necessary for speech synthesis such as pronunciation information and accent information, and creates the context information based on the obtained pronunciation information and language information. The context information may be created based on corrected pronunciation and accent information corresponding to separately prepared input text. The context information is information used as a unit for classifying speech such as a phoneme, a semi-phoneme, and a syllable HMM.

For example, when the phoneme is used as a phonetic unit, a sequence of phoneme names can be used as the context information. Further, it is possible to use the context information including triphone in which a preceding phoneme and a subsequent phoneme are added; phoneme information that includes two previous and subsequent phonemes each; phoneme type information that represents classification by voiced sound and unvoiced sound and represents an attribute of further detailed phoneme type; and linguistic attribute information such as the information on a position of each phoneme in a sentence, in a breath group, and in an accent phrase, the mora number and an accent type of an accent phrase, a mora position, a position up to an accent nucleus, information on presence or absence of rising intonation, and information on a granted phonetic symbol.

Figure 27:
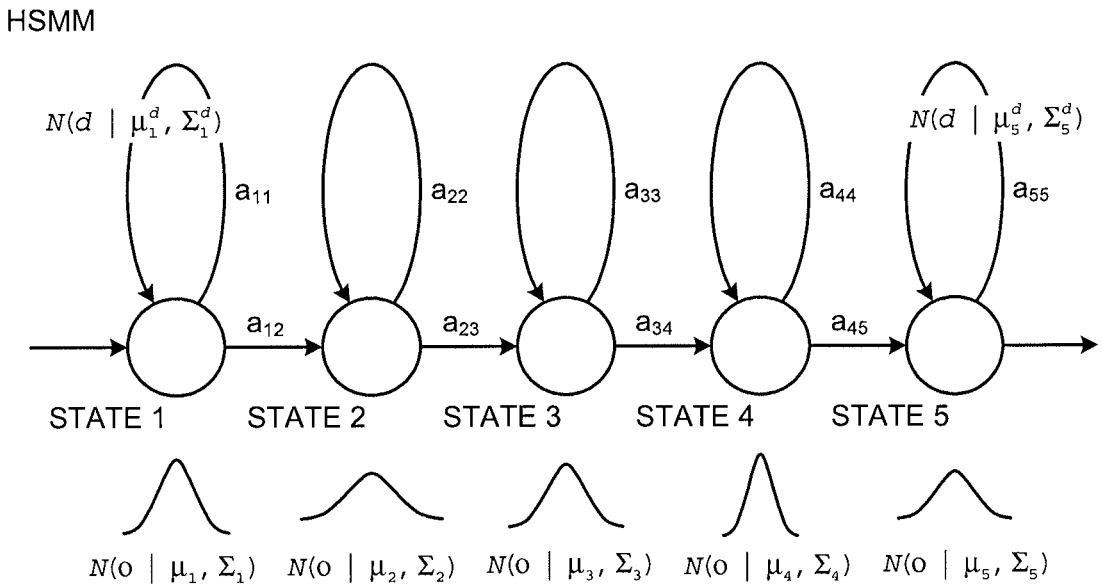
FIG. 27 is a view illustrating an overview of HMM.

The HMM sequence creation unit 2602 creates the HMM sequence corresponding to the input context information based on the HMM information stored in the HMM storage unit 2605. The HMM is a statistical model expressed by a state transition probability and an output distribution of each state. When a left-to-right HMM is used as the HMM, as illustrated in FIG. 27, it is modeled by an output distribution $N(o|\mu_i, \Sigma_i)$ of each state and a state transition probability $a_{ij}$ ($_i$ and $_j$ are state indices), and is modeled in a form that only the transition probability to an adjacent state and the self-transition probability have values. Here, one that uses a duration distribution $N(d|\mu_i^d, \Sigma_i^d)$ instead of the self-transition probability $a_{ij}$ is referred to as a hidden semi-Markov model (HSMM), and is used in modeling a duration.

Figure 28:
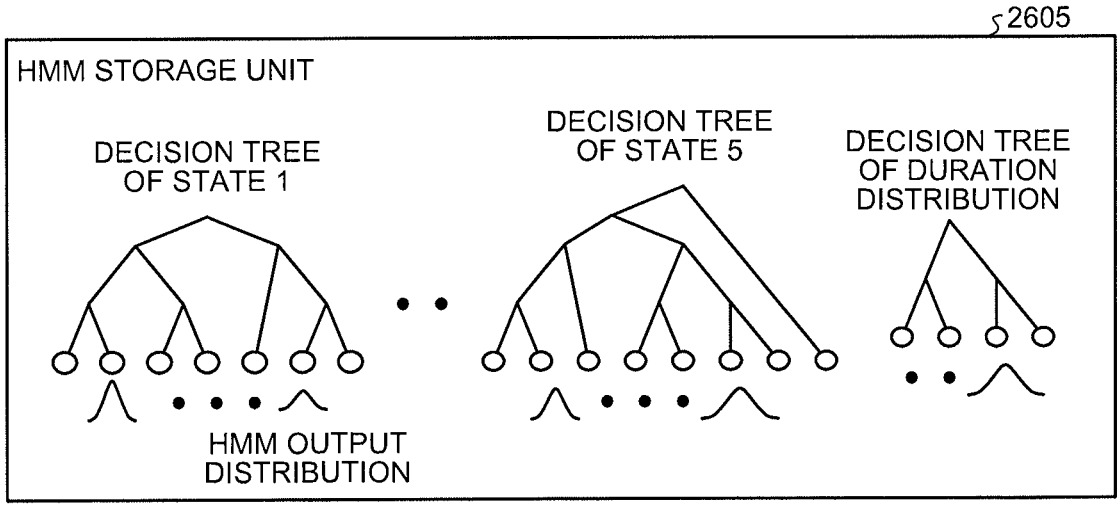
FIG. 28 is a view illustrating an overview of an HMM storage unit.

The HMM storage unit 2605 stores a model obtained by decision tree clustering of the output distribution of each state of the HMM. In this case, as illustrated in FIG. 28, the HMM storage unit 2605 stores a decision tree which is a model of feature parameters of the respective states of the HMM and an output distribution of each leaf node of the decision tree, and further stores a decision tree and a distribution for the duration distribution. Each node of the decision tree is associated with questions to classify the distribution, for example, "whether it is silence", "whether it is a voiced sound", and "whether it is an accent nucleus", and the nodes are classified into a child node to which the question is relevant, or into a child node to which the question is not relevant. The decision tree is retrieved by determining whether input context information corresponds to the question of each node to obtain a leaf node. The HMM corresponding to each speech unit is constructed by using the distribution associated with the obtained leaf node as the output distribution of each state. Thus, the HMM sequence corresponding to the input context information is created.

Figure 29:
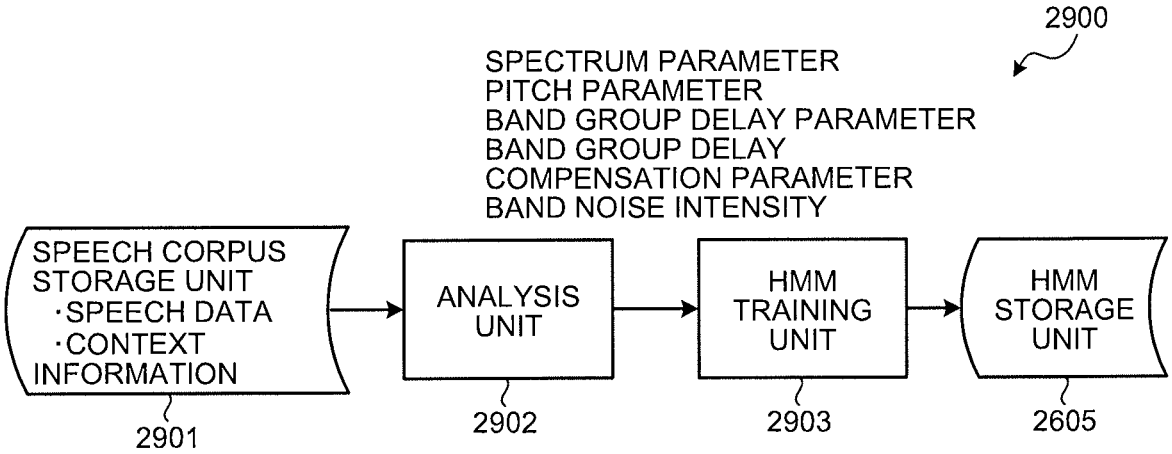
FIG. 29 is a diagram illustrating an overview of an HMM training device.

The HMM stored in the HMM storage unit 2605 is performed by an HMM training device 2900 illustrated in FIG. 29. A speech corpus storage unit 2901 stores a speech corpus including speech data and context information for use in creation of the HMM model.

An analysis unit 2902 analyzes the speech data used for training and obtains the acoustic feature parameter. Here, the band group delay parameter and the band group delay compensation parameter are obtained using the speech analyzer 100 described above and used in combination with the spectrum parameter, the pitch parameter, the band noise intensity parameter, and the like.

Figure 30:
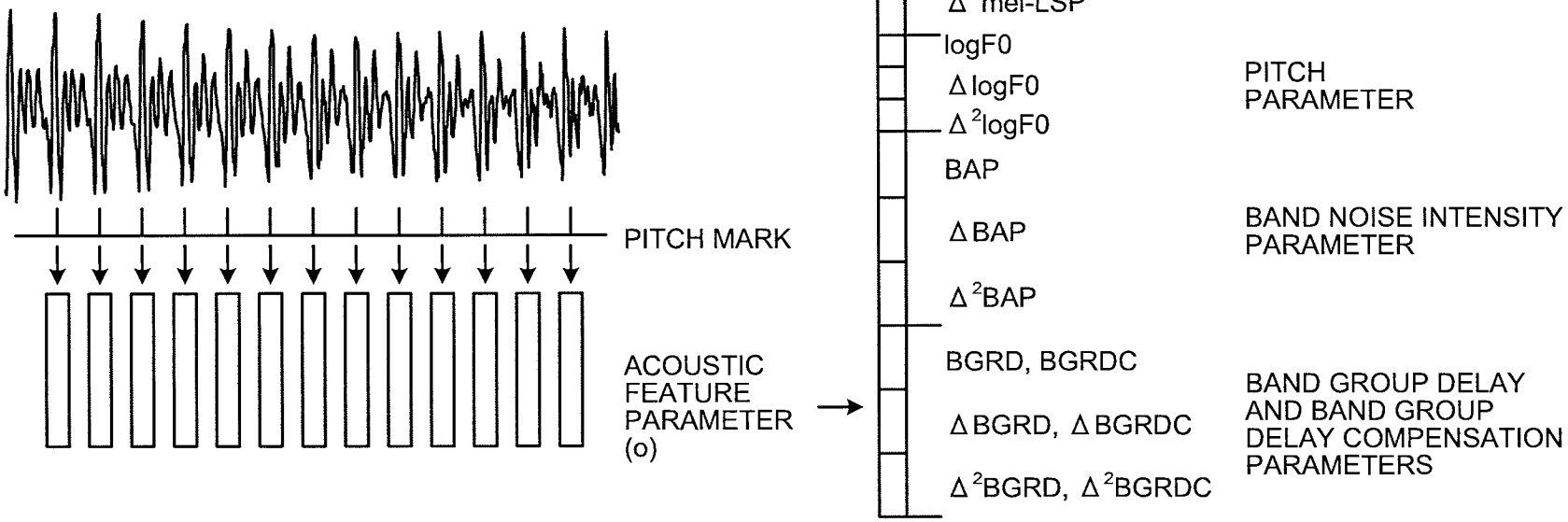
FIG. 30 is a view illustrating processing performed by an analysis unit.

As illustrated in FIG. 30, the analysis unit 2902 obtains the acoustic feature parameter in each speech frame of speech data. The speech frame is a parameter at each pitch mark time in the case of using pitch synchronization analysis. In the case of a fixed frame rate, a feature parameter is extracted by a method of interpolating an acoustic feature parameter of an adjacent pitch mark and using the interpolated parameter, or the like.

An acoustic feature parameter corresponding to a speech analysis center time (a pitch mark position in FIG. 30) is analyzed using the speech analyzer 100 illustrated in FIG. 1 to extract the spectrum parameter (mel-LSP), the pitch parameter (log F0), the band noise intensity parameter (BAP), and the band group delay parameter and band group delay compensation parameters (BGRD and BGRDC). Further, a $\Delta$ parameter and a $\Delta^2$ parameter are obtained as the dynamic feature amount of these parameters and are arranged to be used as the acoustic feature parameters at each time.

Figure 31:
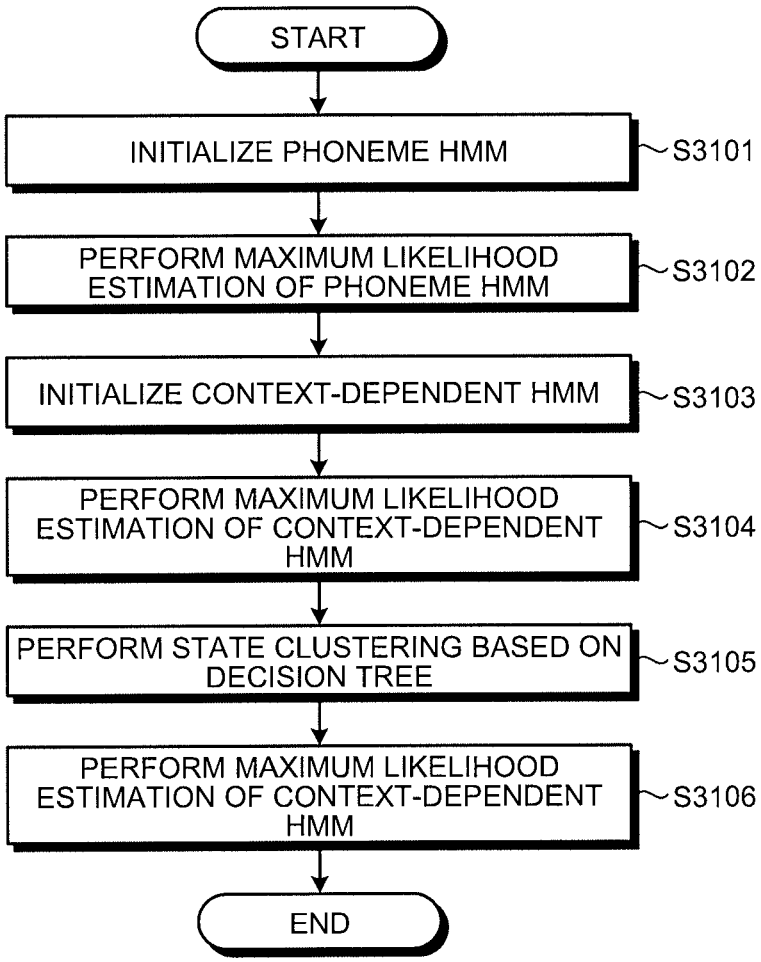
FIG. 31 is a flowchart illustrating processing performed by the HMM training unit.

The HMM training unit 2903 trains the HMM from the feature parameters obtained in this manner. FIG. 31 is a flowchart illustrating processing performed by the HMM training unit 2903. The HMM training unit 2903 initializes a phoneme HMM (S3101), performs maximum likelihood estimation of the phoneme HMM by training of the HSMM (S3102), and trains the phoneme HMM as an initial model. At the time of the maximum likelihood estimation, an HMM and a sentence are associated with each other by embedded training and the respective states and feature parameters are trained while performing probabilistic association therebetween based on the HMM of the whole sentence and acoustic feature parameters corresponding to the sentence.

Next, the HMM training unit 2903 initializes a context-dependent HMM using the phoneme HMM (S3103). As the context, as described above, the phonological environment and language information, such as the phoneme, the preceding and subsequent phonemic environment, the position information within the sentence or accent phrase, the accent type, and whether a sentence is ending up, are used to prepare a model initialized with the phoneme for the context existing in training data.

Then, the HMM training unit 2903 performs training by applying the maximum likelihood estimation based on the embedded training to the context-dependent HMM (S3104), and applies state clustering based on the decision tree (S3105). As a result, the HMM training unit 2903 constructs a decision tree for each state and each stream of the HMM and a state duration distribution of the HMM. Then, the HMM training unit 2903 trains a rule for classifying the model based on a maximum likelihood criterion or a minimum description length (MDL) criterion from the distribution for each state and stream, and constructs a decision tree illustrated in FIG. 28. In addition, at the time of speech synthesis, the distribution of each state is selected by following the decision tree even when an unknown context that does not exist in the training data is input, so that it is possible to construct a corresponding HMM.

Finally, the HMM training unit 2903 performs maximum likelihood estimation of a context-dependent clustered model, and the model training is completed (S3106). At the time of clustering, a decision tree of each stream of the band group delay and band group delay compensation parameters as well as the spectrum parameters (mel-LSP), the pitch parameters (logarithmic fundamental frequency), and the band noise intensities (BAP) is constructed by constructing a decision tree for each stream of each feature quantity. In addition, a duration distribution decision tree in units of HMMs is constructed by constructing a decision tree for a multi-dimensional distribution in which a duration of each state is arranged. These obtained HMM and decision tree are stored in the HMM storage unit 2605.

The HMM sequence creation unit 2602 (FIG. 26) creates the HMM sequence from the input context and the HMM stored in the HMM storage unit 2605, and creates a distribution sequence by repeating the distribution of each state according to the number of frames defined by the duration distribution. The generated distribution sequence is a sequence in which distributions corresponding to the number of output parameters are arranged.

The parameter generation unit 2603 generates a smooth parameter sequence by generating the respective parameters using a parameter generation algorithm that considers the static and dynamic feature amount widely used for speech synthesis based on the HMM.

Figure 32:
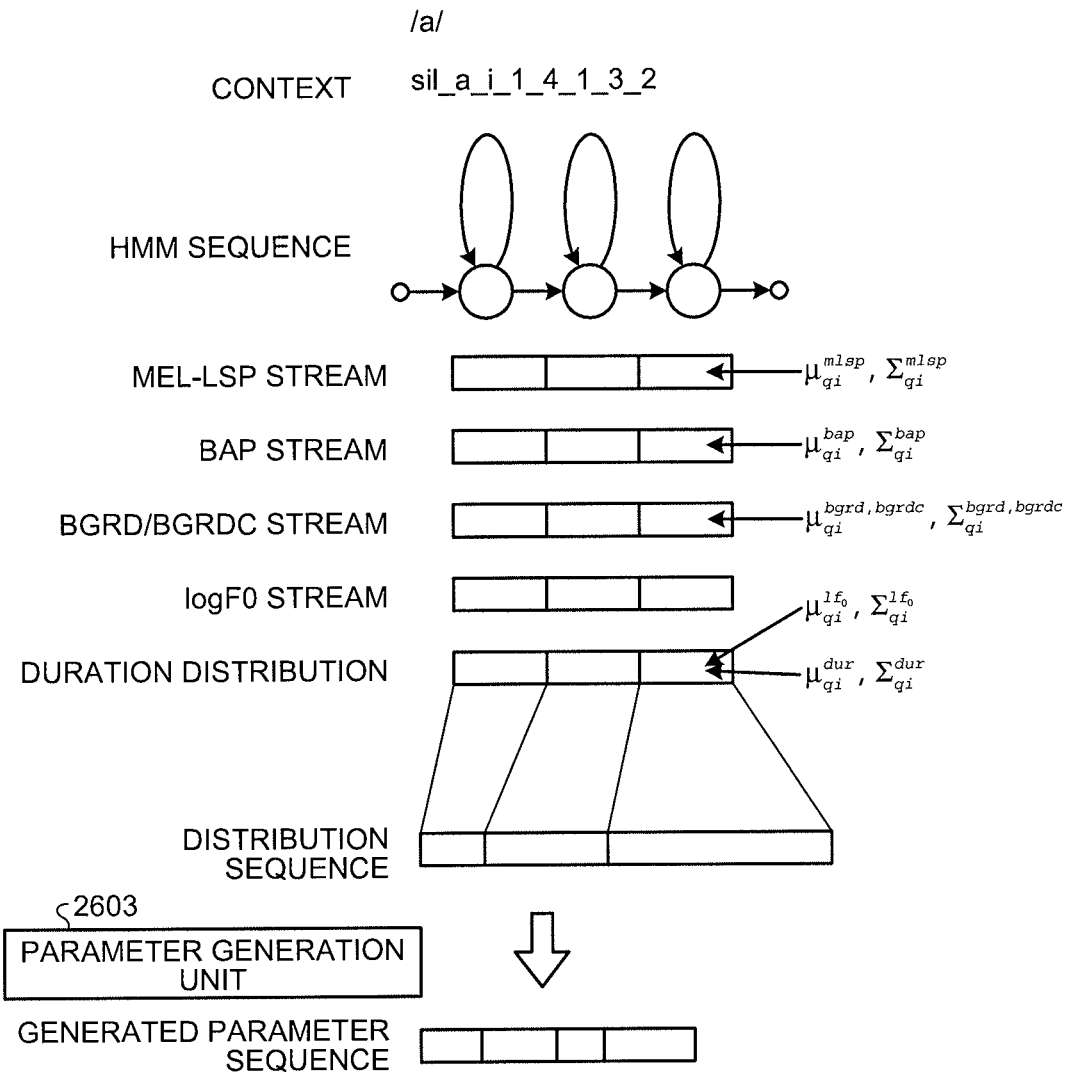
FIG. 32 is a view illustrating a construction example of an HMM sequence and a distribution sequence.

FIG. 32 is a view illustrating an example of construction of the HMM sequence and distribution sequence. First, the HMM sequence creation unit 2602 selects the distribution and duration distribution of each state and each stream of HMMs of input context, and constructs a sequence of HMMs. When synthesizing "red" by using "preceding phoneme_corresponding phoneme_subsequent phoneme_phoneme position_phoneme number_mora position_mora number_accent type", context "sil_a_k_1_3_1_2_1" is obtained since a preceding phoneme "sil", a corresponding phoneme "a", a subsequent phoneme "k", a phoneme position 1, a phoneme number 3, a mora position 1, a mora number 2, and an accent type 1 are given as for an initial phoneme of "a" assuming that 2 mora 1 type.

When following the decision tree of the HMM, a question, such as, whether the phoneme is "a" and whether the accent type is a type 1, is set at each intermediate node, and a distribution of leaf nodes is selected by following the question, and distributions of the respective stream and the duration distribution of mel-LSP, BAP, BGRD and BGRDC, and Log F0 are selected for each state of the HMM, and the HMM sequence is constructed. In this manner, the HMM sequence and the distribution sequence for each model unit (for example, the phoneme) are formed, and the distribution sequence corresponding to the input sentence is created by arranging the HMM sequence and the distribution sequence for the whole sentence.

The parameter generation unit 2603 generates the parameter sequence by the parameter generation algorithm using the static and dynamic feature amount from the created distribution sequence. When $\Delta$ and $\Delta^2$ are used as dynamic feature parameters, output parameters are obtained by the following method. A feature parameter $o_t$ at a time t is expressed as $o_t=(c_t', \Delta c_t', \Delta 2c_t')$ by using a static feature parameter $c_t$ and dynamic feature parameters $\Delta c_t$ and $\Delta^2 c_t$ determined from feature parameters of preceding and subsequent frames. A vector $C=(c_0', \ldots, {}_{cT-1}')'$ formed of the static feature amount $c_t$ that maximizes $P(O|J, \lambda)$ is obtained by solving the following equation of Formula 15 with 0TM as a zero vector in a T×M order.

$$\frac{\partial}{\partial C}\log P(O \mid J, \lambda, T) = 0_{TM} \tag{15}$$

Where T is the number of frames and J is a state transition sequence. When a relationship between a feature parameter O and a static feature parameter C is associated by a matrix W for calculation of a dynamic feature, it is expressed as O=WC. Here, O is a vector of 3TM, C is a vector of TM, and W is a matrix of 3TM×TM. Then, an average vector of distributions corresponding to a sentence in which an average vector of the output distribution at each time and all diagonal covariances are arranged and a covariance matrix are $\mu=(\mu_{s00}', \ldots, \mu_{sJ-1Q-1}')'$ and $\Sigma=\mathrm{diag}(\Sigma_{s00}', \ldots, \Sigma_{sJ-1Q-1}')'$, an optimum feature parameter sequence C is obtained by solving the following equation in Formula 16.

$$W\Sigma^{-1}WC=W\Sigma^{-1}\mu \tag{16}$$

This equation is obtained by a method based on Cholesky decomposition. In addition, it is also possible to generate the parameter sequence in order of time along with a delay time, and it is also possible to generate the parameter sequence with low delay, which is similar to a solution used for a time update algorithm of a RLS filter. Incidentally, the parameter generation processing is not limited to the above-described method, and an arbitrary method of generating a feature parameter from another distribution sequence, such as a method of interpolating an average vector, may be used.

The waveform generation unit 2604 generates a speech waveform from the parameter sequence generated in this manner. For example, the waveform generation unit 2604 synthesizes speech from the mel-LSP sequence, the log F0 sequence, the band noise intensity sequence, the band group delay parameter, and the band group delay compensation parameter. When these parameters are used, the waveform is generated using the above-described speech synthesizer 1100 or speech synthesizer 1400. Specifically, the waveform is generated using the configuration by the inverse Fourier transform illustrated in FIG. 23 or the fast waveform generation of the vocoder type illustrated in FIG. 25. When the band noise intensity is not used, the speech synthesizer 1200 by the inverse Fourier transform illustrated in FIG. 12 or the speech synthesizer 1400 illustrated in FIG. 14 is used.

Through these processes, the synthesized speech corresponding to the input context is obtained, and it is possible to synthesize the speech similar to the analysis source speech, which also reflects the phase information of the speech waveform by using the band group delay parameter and the band group delay compensation parameter.

Although the configuration in which a speaker-dependent model is subjected to the maximum likelihood estimation using a corpus of a specific speaker has been described in the above-described HMM training unit 2903, but the invention is not limited thereto. It is also possible to use different configurations such as a speaker adaptation technique, a model interpolation technique, used as technique for improving diversity of HMM speech synthesis, and a cluster adaptation technique, and a different training method, such as distribution parameter estimation using a deep neural network, may be used.

In addition, the speech synthesizer 2600 may be configured to further include a feature parameter sequence selection unit that selects a feature parameter sequence between the HMM sequence creation unit 2602 and the parameter generation unit 2603, to select a feature parameter among candidate acoustic feature parameters obtained by the analysis unit 2902 targeting the HMM sequence, and to synthesize a speech waveform from the selected parameter. When the selection of the acoustic feature parameter is performed in this manner, sound quality deterioration caused by excessive smoothing of HMM speech synthesis can be suppressed, and natural synthesized speech closer to actual utterance is obtained.

As the band group delay parameter and the band group delay compensation parameter are used as the feature parameters of speech synthesis, it is possible to generate the waveform rapidly while enhancing the reproducibility of the waveform.

Incidentally, the speech synthesizer such as the above-described speech analyzer 100 and speech synthesizer 1100 can be realized by using a general-purpose computer device as basic hardware, for example. That is, the speech analyzer and the respective speech synthesizers according to the present embodiment can be realized by causing a processor mounted in the computer device to execute a program. At this time, the program may be installed in advance in the computer device and realized. Alternatively, the above-described program may be stored in a storage medium such as a CD-ROM or distributed through the network and realized by appropriately installing the program in the computer device. In addition, it is possible to realize the program by appropriately using a memory built in or externally attached to the computer device, a hard disk, or a storage medium such as a CD-R, a CD-RW, a DVD-RAM, and a DVD-R. Incidentally, a part or the whole of the speech synthesizer, such as the speech analyzer 100 and the speech synthesizer 1100, may be configured by hardware or may be configured by software.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speech processing device comprising:

a hardware processor configured to receive input speech and extract speech frames from the input speech;

calculate a spectrum parameter for each of the speech frames;

calculate a first phase spectrum for each of the speech frames;

calculate a group delay spectrum from the first phase spectrum based on a frequency component of the first phase spectrum;

calculate a band group delay parameter in a predetermined frequency band from the group delay spectrum;

calculate a band group delay compensation parameter to compensate a difference between a second phase spectrum reconstructed from the band group delay parameter and the first phase spectrum; and generate a speech waveform based on the spectrum parameter, the band group delay parameter, and the band group delay compensation parameter.

2. The speech processing device according to claim 1, wherein the hardware processor is configured to:

calculate an average value of group delays in a predetermined frequency band or an average value of group delays weighted based on a spectrum or a power spectrum as the band group delay parameter of each frequency band, and reconstruct the second phase spectrum from a low-frequency band based on the band group delay parameter, and calculates the band group delay compensation parameter to compensate the difference between the second phase spectrum and the first phase spectrum at a boundary frequency of each frequency band.

3. A speech processing method comprising:

receiving input speech and extract speech frames from the input speech;

calculating a spectrum parameter for each of the speech frames;

calculating a first phase spectrum for each of the speech frames;

calculating a group delay spectrum from the first phase spectrum based on a frequency component of the first phase spectrum;

calculating a band group delay parameter in a predetermined frequency band from the group delay spectrum;

calculating a band group delay compensation parameter to compensate a difference between a second phase spectrum reconstructed from the band group delay parameter and the first phase spectrum; and generating a speech waveform based on the spectrum parameter, the band group delay parameter, and the band group delay compensation parameter.

4. A computer program product comprising a non-transitory computer-readable medium including a speech processing program configured to cause a computer to execute:

receiving input speech and extracting speech frames from the input speech;

calculating a spectrum parameter for each of the speech frames;

calculating a first phase spectrum for each of the speech frames;

calculating a group delay spectrum from the first phase spectrum based on a frequency component of the first phase spectrum;

calculating a band group delay parameter in a predetermined frequency band from the group delay spectrum;

calculating a band group delay compensation parameter to compensate a difference between a second phase spectrum reconstructed from the band group delay parameter and the first phase spectrum; and generating a speech waveform based on the spectrum parameter, the band group delay parameter, and the band group delay compensation parameter.

* * * * *